United States Patent [19]

Buck, Jr. et al.

[11] 3,998,150

[45] Dec. 21, 1976

[54] COTTON PACKAGING METHOD AND APPARATUS

[75] Inventors: George S. Buck, Jr.; Roger Russell, both of Memphis, Tenn.

[73] Assignee: Cotton, Incorporated, Raleigh, N.C.

[22] Filed: Jan. 21, 1976

[21] Appl. No.: 650,982

Related U.S. Application Data

[62] Division of Ser. No. 532,008, Dec. 12, 1974, Pat. No. 3,948,021.

[52] U.S. Cl. ..... 100/269 R

[51] Int. Cl.[2] ..... B30B 1/32

[58] Field of Search ..... 100/42, 76, 77, 80, 100/152, 153, 161, 167, 269 R, 258 A; 53/117, 124 CC

[56] References Cited

UNITED STATES PATENTS

| | | | |
|---|---|---|---|
| 629,716 | 7/1899 | Deane | 100/80 XA |
| 655,998 | 8/1900 | Taylor | 53/117 |
| 696,432 | 4/1902 | Harvey | 100/80 |
| 784,579 | 3/1905 | Luce | 100/40 X |

*Primary Examiner*—Billy J. Wilhite
*Attorney, Agent, or Firm*—Burns, Doane, Swecker & Mathis

[57] ABSTRACT

In a cotton packaging system including a press section, transfer section, strapping section, bagging section and shrink section in longitudinal alignment, a cotton bale is formed by successive compression of overlapping cotton layers and is thereafter tied and bagged. The press section includes a vertically movable lower platen and stationary upper platens each presenting transient compression and conveyor surfaces that are oscillated during bale formation.

16 Claims, 23 Drawing Figures

3.
202
124
42
72
234
121
122
232
80
128
78
260
119
126
120
130
118
87
85
76
38
84
92
134
168
172
170
40
308
310
13.

FIG. 4
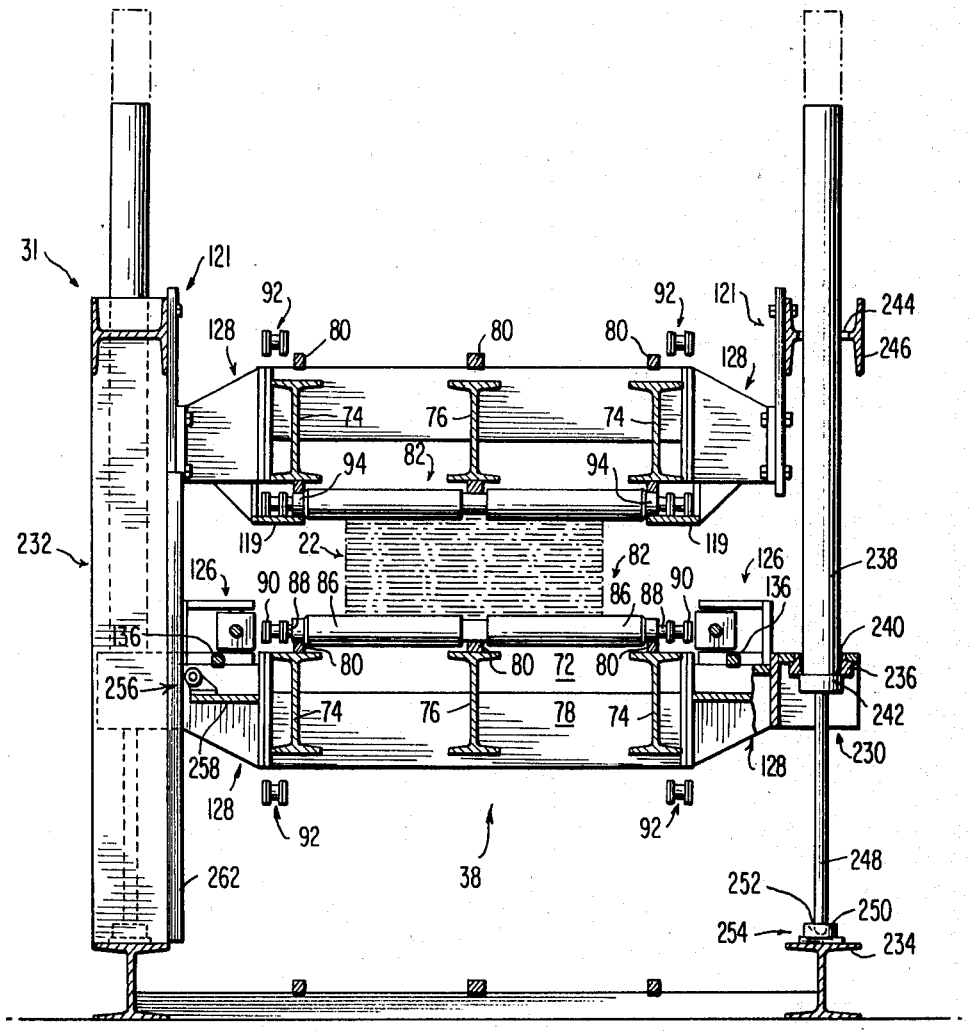
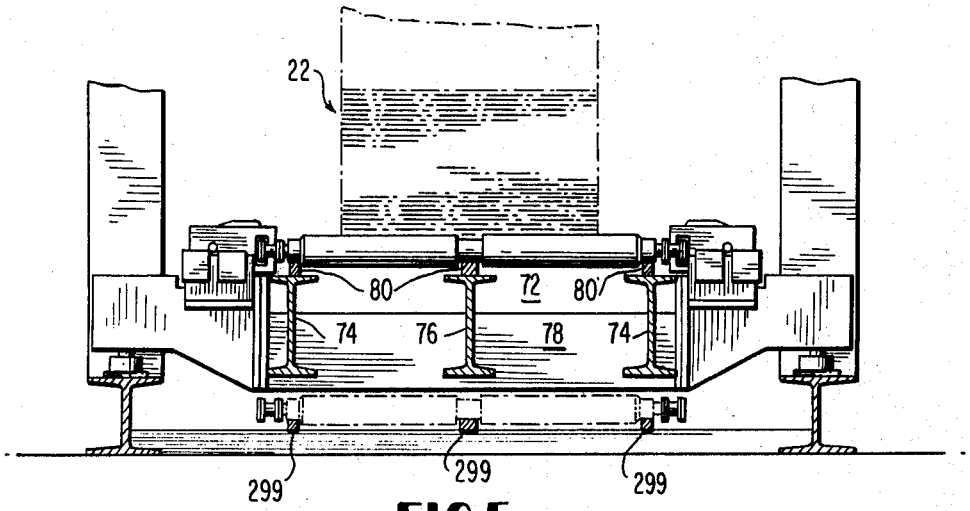
FIG. 5

COTTON PACKAGING METHOD AND APPARATUS

This is a division of application Ser. No. 532,008, filed Dec. 12, 1974, now U.S. Pat. No. 3,948,021.

BACKGROUND OF THE INVENTION

This invention relates to the baling of cotton. More particularly, this invention relates to a cotton baling press and packaging techniques associated therewith.

In the conventional packaging of cotton, the fiber is dumped into a bale box from a feed system which is periodically interrupted to enable a tramper to press the fiber into the box to make room for more from the feed. After each tramping, dogs in the sides of the bale box engage the mass of fiber and keep it more-or-less in the tramped configuration.

When the bale box has been filled with tramped fiber, it is usually rotated to a second position while another box replaces it so that the feeding and tramping operation can continue. The fiber in the original bale box, in its new position, is then further compressed into the final bale form. Generally this is accomplished by an hydraulic ram which, in the more common instances, presses up from the bottom of the bale, or in some cases may press down from the top. Since the horizontal cross-section of the bale box is usually about two feet by four and one-half feet, and since it may be desirable to achieve densities of from ten to thiry pounds per cubic foot of fiber, considerable hydraulic pressure is required, and very heavy, expensive presses are needed to achieve densities of more than about eighteen pounds per cubic foot.

In many cases the volume of production does not justify the cost of the heavy presses needed to achieve the customary densities of about 20 to 22 pounds per cubic foot used for shipping bales to domestic mills, or the even higher densities of 30 to 32 pounds per cubic foot employed in shipping cotton to overseas mills. To achieve these higher densities, bales from the gin, which are usually called "bin bales" or "flat bales", are shipped to compress companies where they are recompressed to the higher densities of very heavy steam-actuated compress machines.

In some instances bales which have been compressed a second time to 20 to 22 pounds for domestic shipment are pressed a third time to 30 to 32 pounds if their destination has been changed to that of an overseas mill.

The recompression of bales necessitates replacement of the steel bale bands or ties, as well as labor and handling charges. Occasionally, the covering material, such as jute or burlap, must also be replaced. All this adds to cost and inefficiency.

Bales or packages of cotton usually weigh between about four hundred and seven hundred pounds, with the average weight being in the range of five hundred to five hundred fifty pounds. When such a mass of fibers is compressed with conventional equipment, each individual fiber must be displaced or deformed, and this in turn brings into play various forces that resist the compression, including inter-fiber friction and resistance to bending, stretching, and torsional deformation. The sum of these forces from hundreds of millions of fibers must be overcome, and in addition air entrapped between the fibers must either be expelled or compressed. These factors together account for the very high pressures and heavy equipment which must be employed in conventional methods of packaging and compression of bales of cotton. The cross-sectional area upon which pressure is applied may approximate 1,400 square inches, and the hydraulic pressure in the ram cylinder may have to be as high as 3,000 pounds per square inch. This in turn means that higher capacity, more expensive pumps, requiring as high as one hundred horsepower motors must be employed.

The resulting high cost of equipment for conventional presses, with automatic strapping severly limits their usefulness.

The present invention embodies a recognition that if the amount of fiber to be compressed at any one time can be sharply reduced, and if the pressure can be applied over a much smaller area, the forces necessary for compression are greatly reduced.

That principle has been adopted experimentally in the production of round bales of cotton where a batt of cotton is passed between squeeze rolls and, upon emerging, is formed into a cylinder-shaped roll, aided by the use of additional rollers to retain the compression imparted by the original pair of "squeeze rolls." However, round bales are not generally acceptable to textile mills since they cannot be packed and shipped as efficiently as rectilinear bales or packages, and they are more difficult to handle during warehousing and processing.

A variety of prior proposals have contemplated the formation of rectilinear type cotton bales through the application of pressure over the area of successive cotton layers. Such proposals may not be entirely acceptable for a variety of reasons.

For example, relative movement between the bale and compression roller assemblies during bale formation may involve a significant amount of undesirable power losses attributable to the recompression of cotton in a given layer. In this connection, it will be appreciated that during relative movement between the cotton layer and the rollers, the cotton compressed by each roller sequentially expands toward the interstices between adjacent rollers and is recompressed by the next roller. This may tend to occur despite the inclusion of belts or the like around the roller assemblies.

Other proposals appear to avoid the losses associated with relative translation between the cotton and the compression elements through the use of compression elements carried as part of a chain assembly.

However, such proposals require complex mechanisms for the mounting of the compression elements and for the maintenance of pressure on the cotton through those compression elements, which mechanisms may not provide adequate support from the standpoint of mounting compression elements to withstand the high pressures involved.

Moreover, those proposals might involve a significant amount of undesirable power losses by reason of reciprocation of either the support for the bale or the support for the chain assembly during bale formation. In this regard, it will be apparent that such proposals might also present significant problems in relation to removal of the completed cotton bale for packaging while maintaining that bale in a compressed condition.

Other difficulties associated with prior proposals designed to form cotton bales through application of pressure over smaller areas of cotton layers may be envisioned.

OBJECTS AND SUMMARY OF PREFERRED FORMS OF THE INVENTION

It is, therefore, a general object of the present invention to provide a cotton baling press and a cotton packaging method which minimize or reduce the problems of the types previously noted.

Another object of the present invention is to provide a novel cotton packaging method and apparatus which avoid unnecessary recompression of cotton while being capable of providing bales of density suitable for both domestic and international shipment.

A further object of the present invention is to provide a novel cotton baling apparatus having a capability to eject a bale formed therein while the bale is still under compression.

A still further object of the present invention is to provide a novel cotton baling press having a capability to eject a bale formed therein while the bale is still under compression and wherein a multiply supported compression element assembly is provided to withstand high compression pressures.

It is a still further object of the present invention to provide a novel cotton baling press having a capability of ejection of a bale formed therein while the bale is still under compression and wherein there is no relative movement between the cotton bale and the compression elements of the bale press while they compressively engage the bale.

It is yet a further object of the present invention to provide a novel cotton baling press wherein upper and lower compression elements are harmonically driven in synchronization.

Another object of the present invention is to provide a novel cotton baling press having compression elements defining a transient compression and conveying surface which is operable to maintain a uniform compression during bale formation.

Yet another object of the present invention to provide a novel cotton packaging method and apparatus wherein a cotton bale is formed and moved to packaging stations in general alignment with one another.

A preferred embodiment of the present invention intended to accomplish the objects set forth herein comprises a cotton packaging apparatus including a press section having press means for forming a compressed bale of cotton and conveyor means for longitudinally ejecting the bale from the press section. A strapping section of the apparatus including strapping means for tying the cotton bale at selected longitudinally spaced locations, and a transfer section includes transfer conveyor means for receiving the ejected bale from the press means and delivering that bale toward said strapping means. The press section, the transfer section and the strapping section are disposed in generally longitudinal alignment.

Both the transfer section and the press section include compression means for maintaining compression on the bale during transfer of the bale to the transfer conveyor means and delivery of the bale toward the strapping means. Preferably, the press means is operable to form a further compressed bale of cotton in the pass section after ejection of a bale previously formed therein, and during delivery of the previously formed bale by the transfer conveyor means toward the strapping means.

The press means and conveyor means of the press section are comprised of superposed platen means defining transient compression and conveyor surfaces that establish a bale forming zone therebetween. First and second upper platen assemblies of the platen means are disposed adjacent but spaced from one another to establish a longitudinally stationary cotton feeding zone therebetween. A lower platen assembly is positioned beneath the extent of both upper platen assemblies.

Compression control means is operable to urge the upper transient compression surfaces and said lower transient compression surface into gripping engagement with cotton in the bale forming zone, and to compressively resist enlargement of the bale forming zone during bale formation. Drive means is provided for oscillating said transient compression and conveying surfaces which are operable in response to the drive means to cause cotton gripped therebetween to traverse the stationary feeding zone and to eject a cotton bale from the baling zone. A bale is formed from overlapping compressed layers of cotton.

That drive means comprises press drive means and transfer drive means. The press drive means oscillates the transient compression and conveyor surfaces in a bale forming mode for bale formation in the press section. The transfer drive means drives the transient compression and conveyor surfaces in a transfer mode to eject a bale from the press section. In addition, the transfer drive means is operable to drive the transfer conveyor means in a transfer mode to incrementally deliver the bale toward the strapping means.

Included in the transfer drive means are first and second independently actuatable clutch means respectively associated with said transfer section and said press section for effecting independent driving of transfer conveyor means and of the transient compression and conveyor surfaces. The first and second clutch means include shiftable sprockets and a chain that remains entrained around the shiftable sprockets during shifting thereof.

The transfer conveyor means is comprised of superposed conveyor assemblies presenting transient conveyor surfaces defining a bale transfer zone therebetween.

The superposed platen means of the press section are relatively movable between a position of adjacency and a spaced position wherein the transient conveyor surfaces of said transfer conveyor means are generally aligned with adjacent portions of said transient compression and conveyor surfaces of the platen means. Compression is maintained on the bale by these adjacent surfaces during transfer of the bale from the press section to the transfer section.

The press section transient compression and conveyor surfaces are moved by an endless chain. Reciprocable latching means for selectively engaging the press section chain in driving relationship therewith is included in the press drive means. This latching means comprises a pivotable dog movable between a chain engaged position and a disengaged position. Alternately operable hydraulically actuable pins are engagable with the dog to move it between its engaged and disengaged positions, and selectively operable position sensing means for operating the pins is provided.

Also included in the press section drive means are master and slave piston and cylinder assemblies for reciprocating the latching means. The master piston and cylinder assemblies include pivotally supported cylinder portions and rod portions pivotally attached to a rotatable gear to enforce harmonic oscillation of the transient compression and conveyor surfaces in response to rotation of said gear.

The transient compression and conveying surfaces associated with the platen assemblies each comprise a plurality of elongate movable conveyor and compression members disposed transversely of the bale forming zone. These elongate members include compression surfaces and end and central bearing surfaces for supporting the members on tracks of the platen frames.

The compression control means includes a plurality of piston and cylinder assemblies disposed in longitudinally spaced positions along each side of the lower platen assembly in force transmitting relationship therewith. Conduit means admits fluid from a fluid supply to the cylinders of the piston and cylinder assemblies and transmits fluid from the cylinders in response to lowering of the lower platen assembly. Adjustable pressure control valve means limits flow of fluid from the cylinders to flow at a predetermined pressure. The outlet flow from at least some and preferably all of the cylinders is isolated from one another by exit check valve means.

Flow divider means generally equalizes flow from the fluid supply means to the longitudinally outermost ones of the cylinders.

Mounting means for the piston and cylinder assemblies permits a limited amount of departure thereof from upright positions and guiding means for guiding movement of the lower platen assembly is operable to accommodate longitudinal accomodate thereof.

Platen movement control means is provided for initiating movement of the lower platen to its upper position, and oscillation control means initiates oscillation of the transient compression and conveying surface. Transfer control and strapping control means are also provided.

Method aspects of the present invention included forming a compressed bale of overlapping cotton layers in a press, and longitudinally ejecting the bale from the press into a transfer station, while continuously maintaining compression on the bale with compression elements in the press and in the transfer station. The compressed bale is longitudinally transferred from the transfer station to a strapping station while continuously maintaining compression on portions of the bale remaining in the transfer station during transfer. Compression is also maintained on the bale on the opposite side of the transfer zone. A further compressed bale is formed while the previously formed bale is transferred to the strapping station.

Other method aspects will be appreciated in conjunction with the foregoing summary directed to mainly apparatus aspects.

Other objects and advantages of the present invention will become apparent from the subsequent detailed description thereof in conjunction with the accompanying drawings in which like reference characters indicate like elements, and in which:

THE DRAWINGS

FIG. 1 is a schematic side elevational view of a cotton packaging apparatus according to the present invention;

FIG. 2 a cross-sectional view, broken away in parts, of the press section of the apparatus of FIG. 1 looking toward one side thereof;

FIG. 4 is a cross-sectional view of the press section taken along line 4—4 of FIG. 3 showing the lower platen in a partially raised position;

FIG. 5 is a partial cross-sectional view of the press section taken along line 5—5 of FIG. 3, and showing the lower platen in its bottom position;

Figure 1:
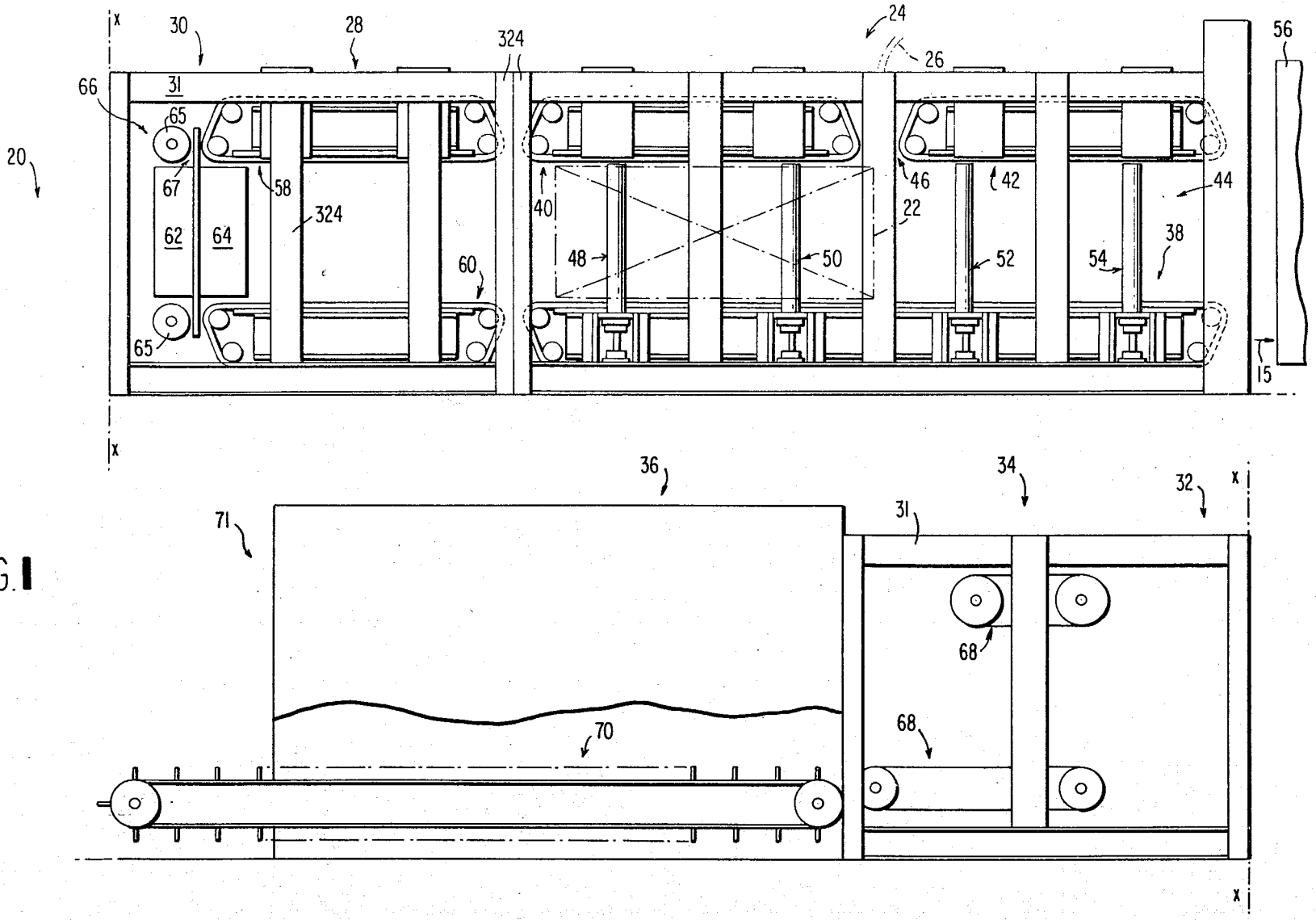
Figure 9:
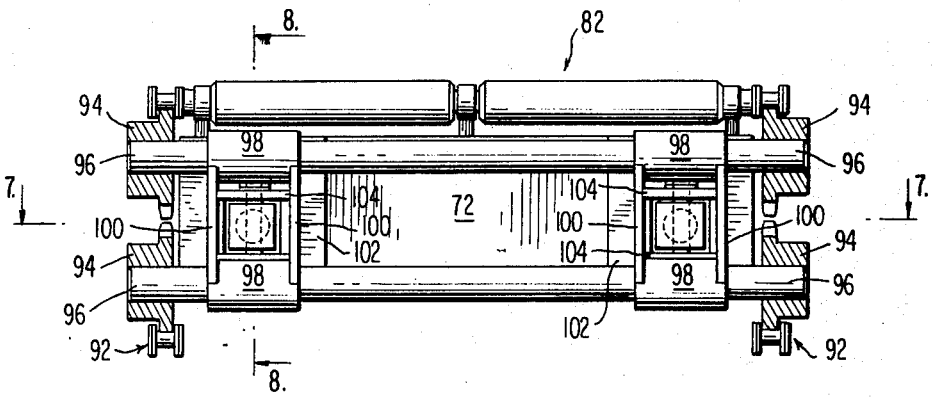
FIG. 9 is an end elevational view of the lower platen assembly.
Figure 8:
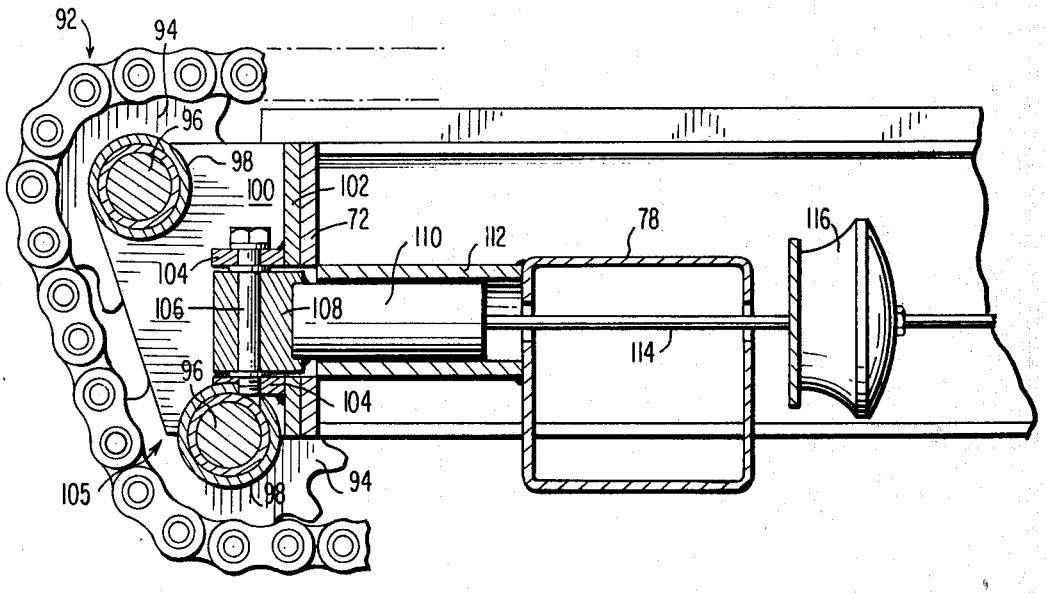
FIG. 8 is a partial cross-sectional view of the lower platen assembly taken along line 8—8 of FIG. 9.
Figure 7:
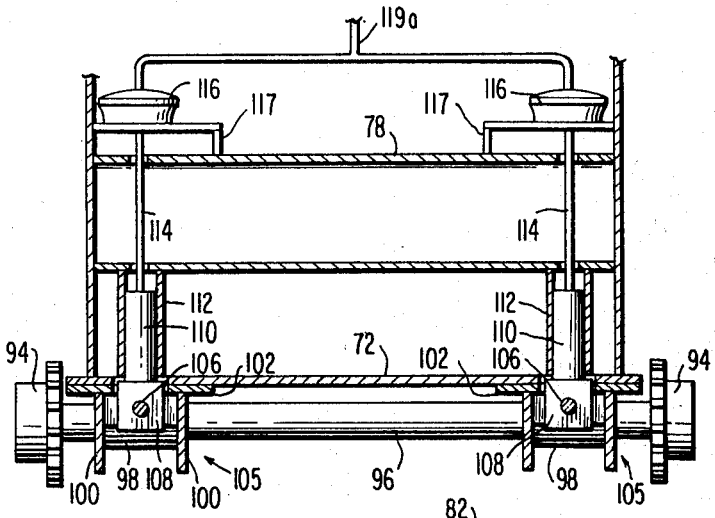
FIG. 7 is a partial sectional view looking down at the lower platen assembly taken along line 7—7 of FIG. 9.
Figure 11:
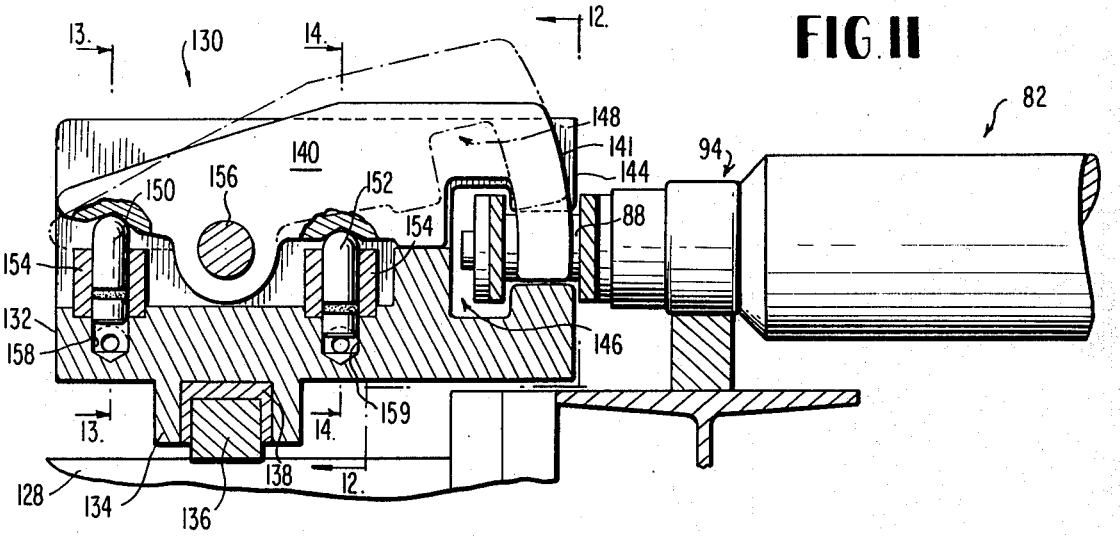
FIG. 11 is a transverse cross-sectional view through one of the latching mechanisms for the drive of the lower platen assembly compression and conveyor elements.
Figure 13:
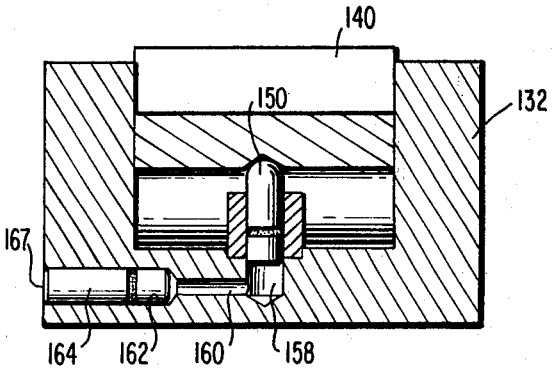
Figure 14:
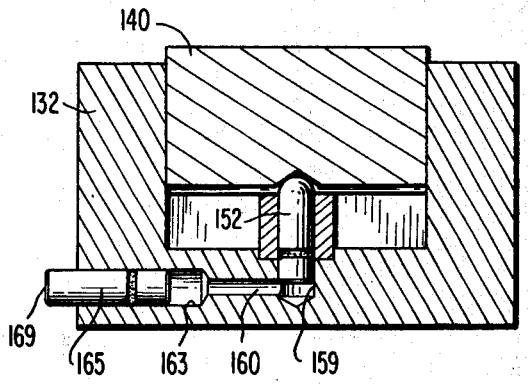
Figure 15:
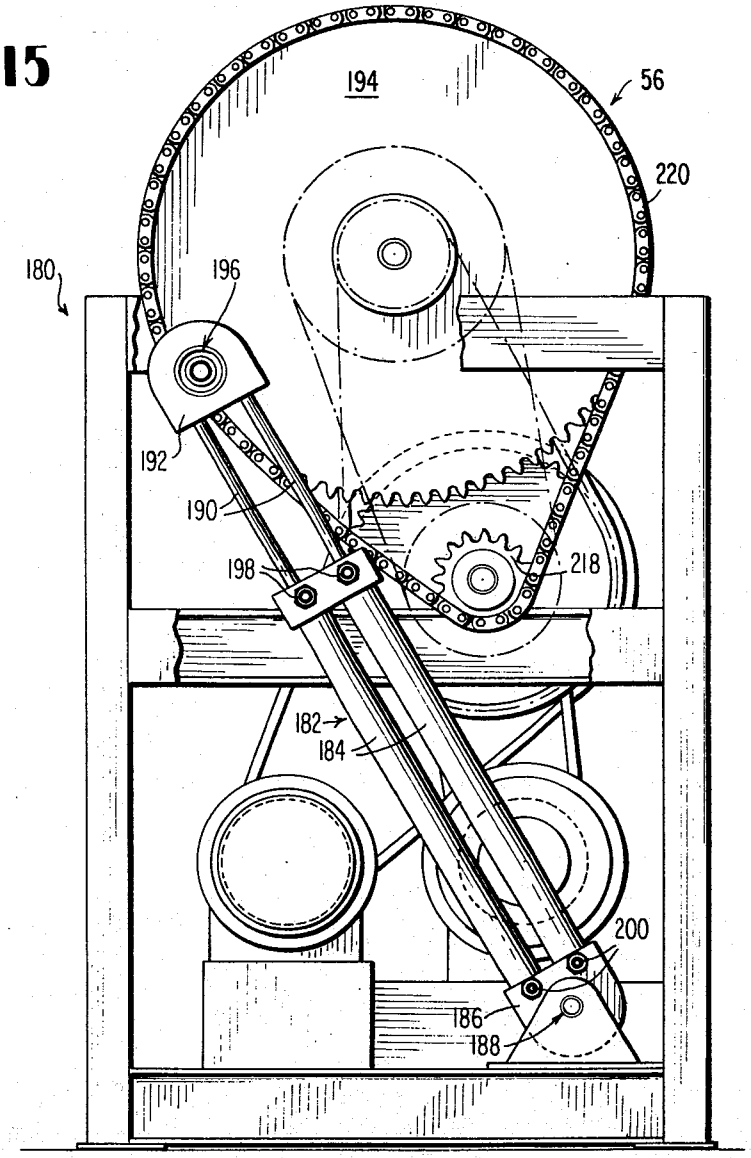
Figure 16:
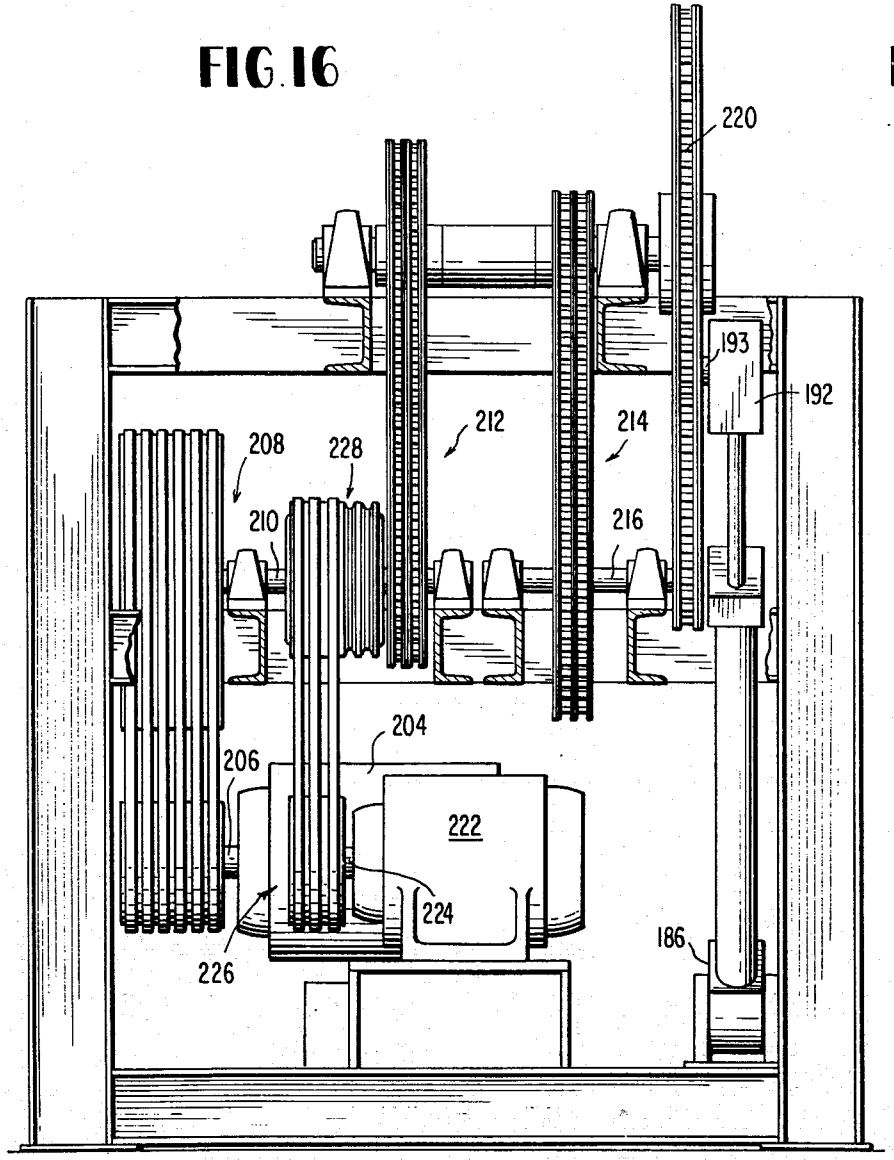
Figure 17:
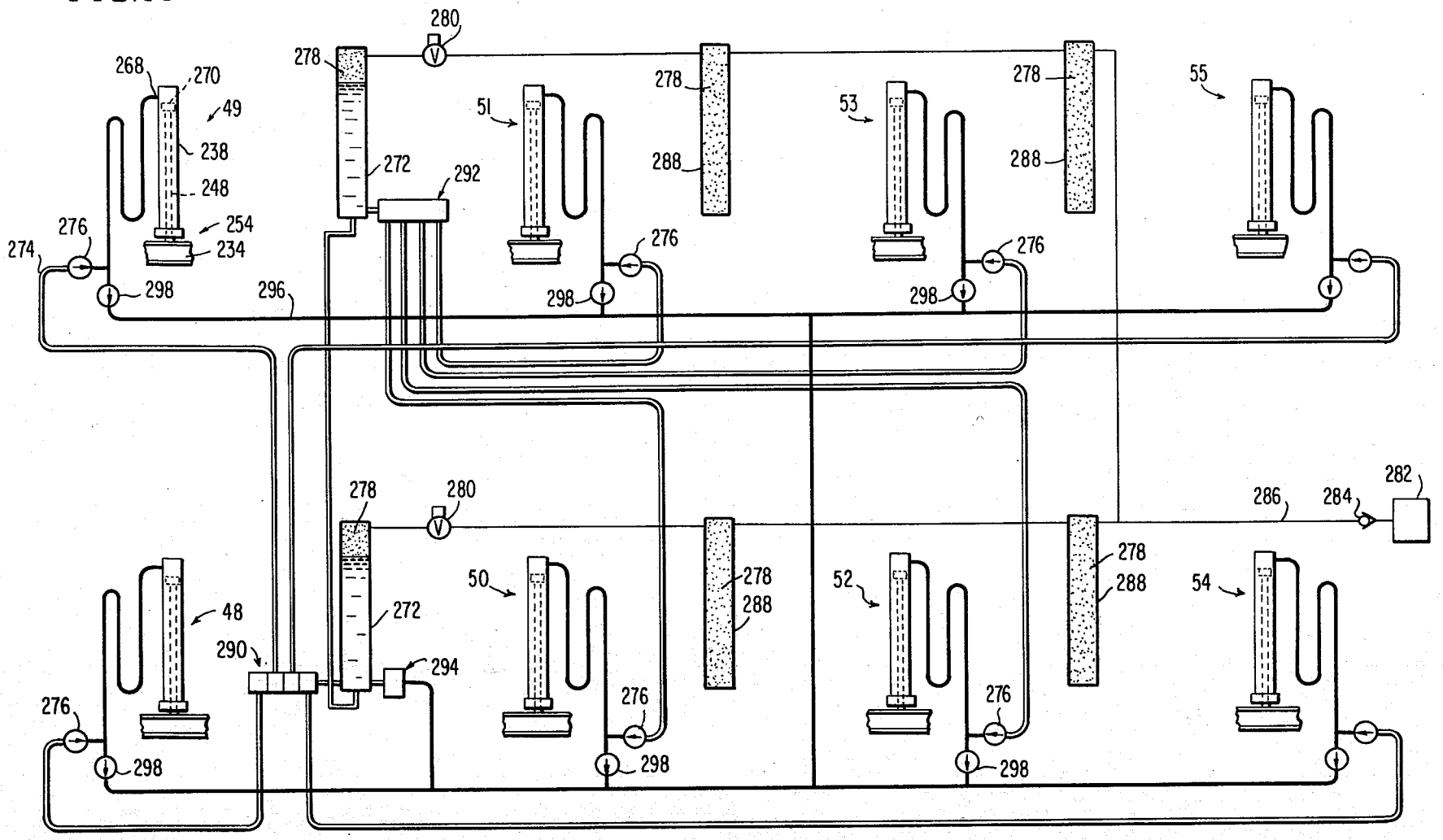
Figure 18:
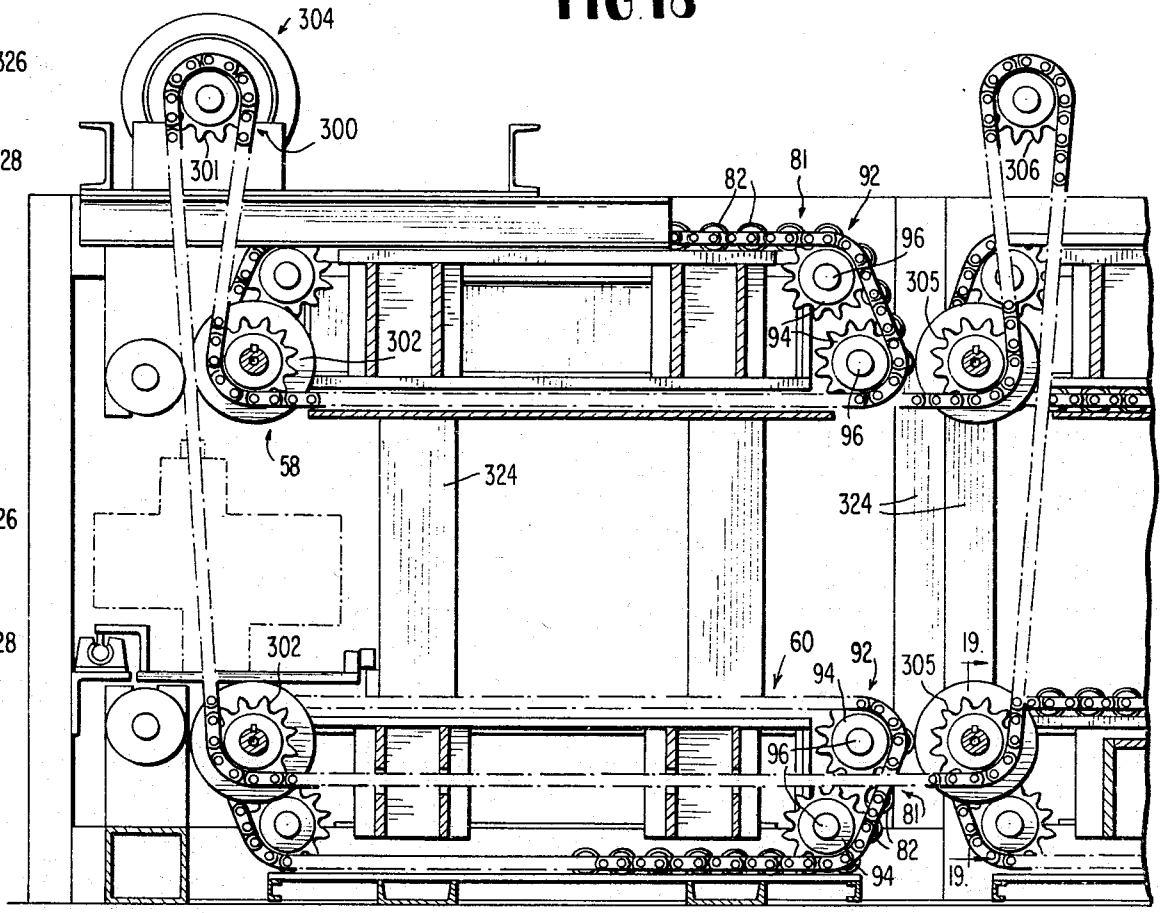
Figure 20:
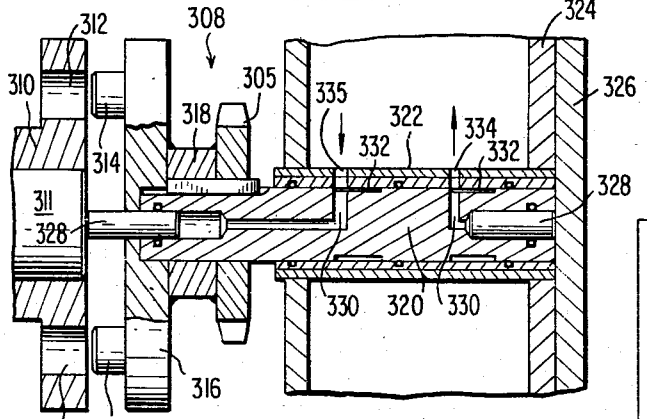
Figure 19:
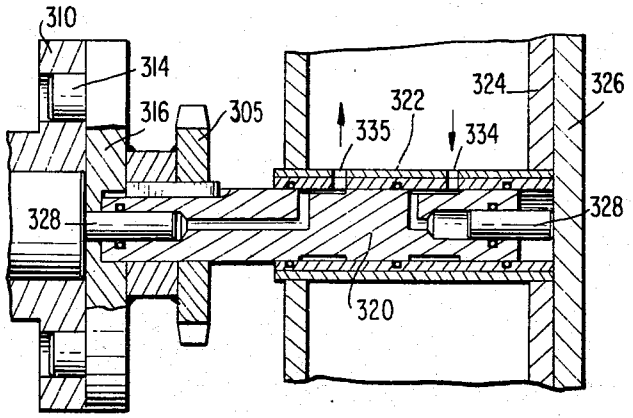
Figure 21:
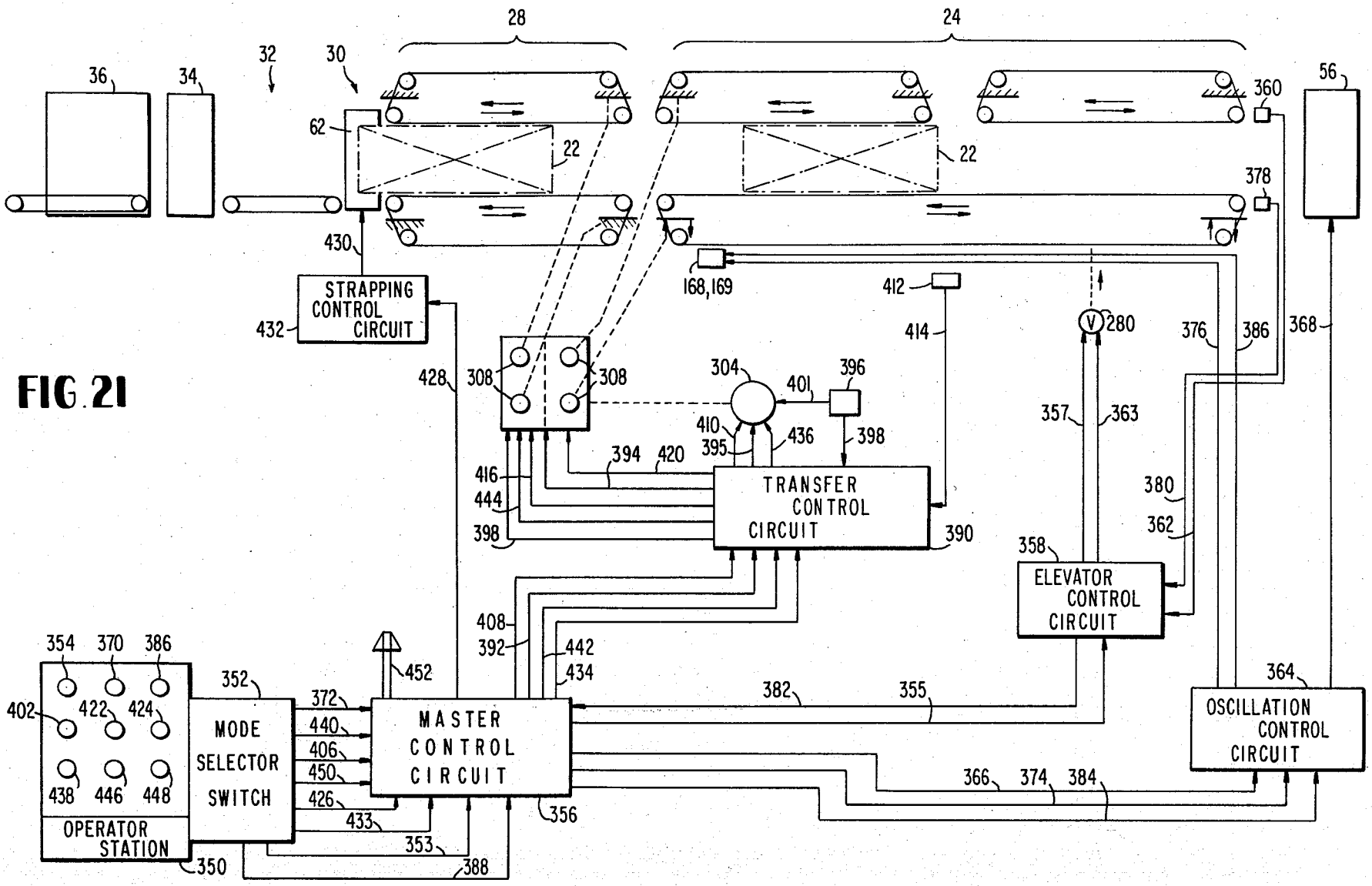
Figure 23:
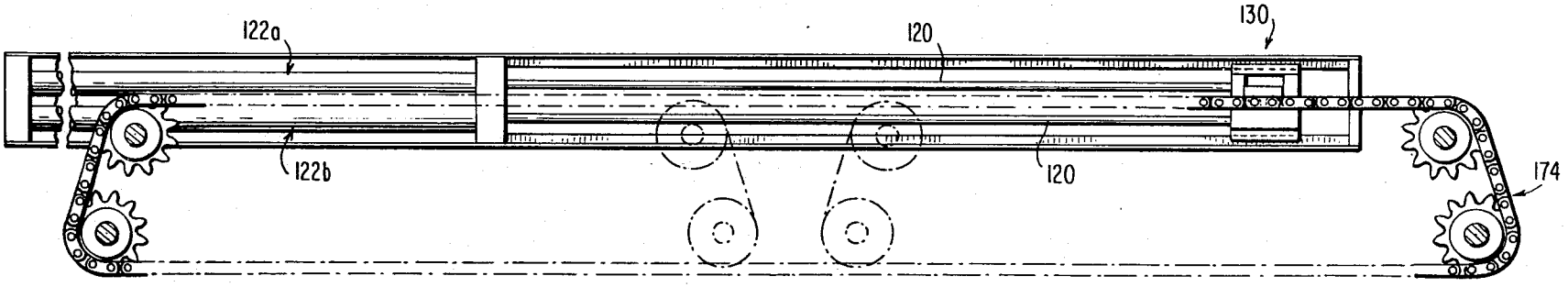
Figure 22:
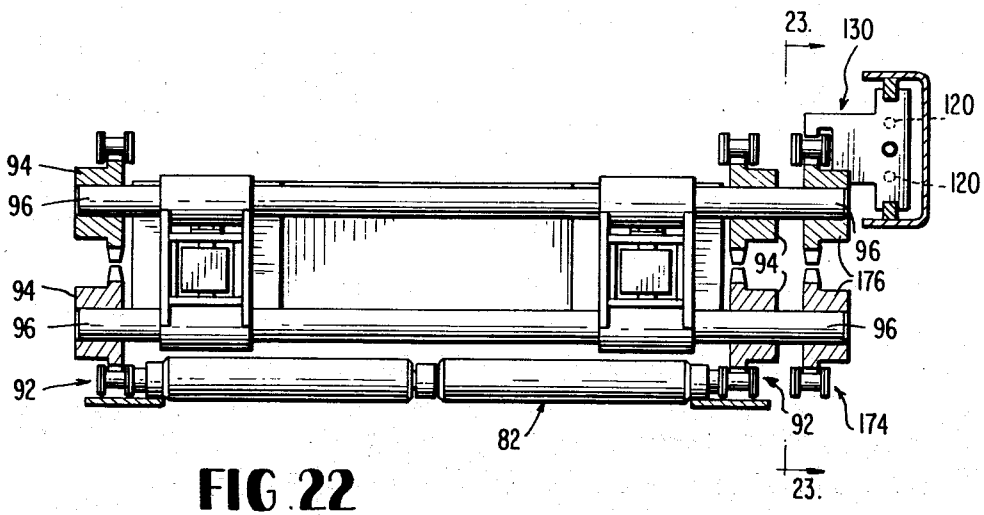

FIGS. 13 and 14 are cross-sectional views respectively taken along lines 13—13 and 14—14 of FIG. 11;

FIG. 15 is a front view of the primary drive assembly for the upper and lower platens of the press looking in the direction of the arrow 15 in FIG. 1;

FIG. 16 is a side view of the assembly shown in FIG. 15;

FIG. 17 is a schematic illustration of the arrangement for controlling the lifting and lowering of the lower platen assembly;

FIG. 18 is a cross-sectional view of the transfer section, strapping section and a portion of the press section of the apparatus of FIG. 1;

FIG. 19 is a partial cross-sectional view taken along line 19—19 of FIG. 18 depicting the clutch mechanism for transferring a bale;

FIG. 20 is a view similar to that of FIG. 19, with the clutch mechanism being shown as disengaged;

FIG. 21 is a schematic diagram depicting operation of the apparatus of FIG. 1;

FIG. 22 is a cross-sectional view similar in orientation to that of FIG. 9 illustrating in isolation portions of the upper platen assembly and its drive; and FIG. 23 is an elevational view taken along line 23—23 of FIG. 22, with parts being shown in phantom.

DETAILED DESCRIPTION

General Summary

With reference to FIG. 1, a schematic illustration of the apparatus 20 according to the present invention may be seen. The apparatus 20 includes a plurality of longitudinally aligned sections mounted on a frame 31. In these sections a bale 22 of cotton is formed, transported and packaged.

The first of these sections is indicated generally at 24 and constitutes a bale forming or press section, operable in a manner hereinafter more fully described to form the cotton bale 22 by successive compression of overlapping layers of cotton provided through folding of a cotton batt 26 upon itself. Details of a preferred method and apparatus for forming and feeding the batt 26 are set forth in copending application SER. No. 532,001, now U.S. Pat. No. 3,948,021 filed concurrently herewith by George S. Buck, Jr. and Roger Russell for "Batt Forming and Feeding Method and Apparatus". The disclosure of that application is hereby incorporated by reference.

After formation, the bale 22 is transported to a transfer section 28 of the apparatus 20, and the press section 24 is readied for formation of another bale. In the transfer section 28, the bale 22 is incrementally advanced to progressively project therebeyond by increasing amounts into a strapping section 30. There the bale 22 is strapped with metal or other suitable bands at longitudinally spaced locations.

A second transfer station 32 moves the bale 22 into a bagging section 34 where a suitable plastic enclosure is disposed about the bale. From the bagging section 34 the bale 22 is transported to a shrink station 36 at which the plastic enclosure is heated to shrink it into essentially intimate contact with the bale.

Returning now to consideration of the press section 24, and still with reference to FIG. 1, it will be seen that the press section includes a lower platen assembly 38, and two upper platen assemblies 40 and 42 located thereabove. Between the upper and lower platen assemblies a bale forming zone 44 is established.

The upper platen assemblies 40 and 42 are disposed adjacent but spaced from one another to define a stationary cotton feeding zone 46 therebetween.

Each of the platen assemblies presents a transient compression and conveying surface described more fully below. Provision is made for urging these transient compression and conveying surfaces into gripping, compressive engagement with cotton introduced into the bale forming zone 44 through the cotton feeding zone 46.

In this connection, a plurality of hydraulic piston and cylinder assemblies 48, 49, 50, 51, 52, 53, 54 and 55 (only four of which may be seen in FIG. 1) are employed. These piston and cylinder assemblies are arranged to lift the lower platen assembly 38 toward the upper platen assemblies 40 and 42 and to resist, under the influence of predetermined hydraulic pressure lowering of the lower platen assembly 38.

As will be appreciated, it is contemplated that certain advantages of the present invention may be realized with the arrangement reversed so that the lower platen assembly remains vertically stationary while the upper platen assemblies are moved vertically.

A drive including synchronizing assembly 56 is provided to reciprocate the transient compression and conveying surfaces of the platen assemblies. In response to the driving force, the compression and conveying surfaces are operable to cause cotton gripped therebetween to traverse the longitudinally stationary cotton feeding zone 46. In turn the batt 26 is caused to fold upon itself as the gripped cotton reverses direction and passes that feeding zone, and the bale 22 is formed in stages.

During bale formation, the compression and conveying surfaces remain in compressive gripping engagement with the cotton while the lower platen assembly 38 is progressively, and forceably, lowered to enlarge the bale forming zone 44 so as to accommodate the added cotton layers.

After an appropriately dimensioned and dense bale 22 is formed, the bale forming function of the press section 24 is temporarily terminated. At that stage, a second drive assembly (not shown in FIG. 1) that is essentially independent of the bale formation drive is engaged to transport the bale 22 into the transfer section 29. Engagement of that second drive assembly causes the compression and conveying surfaces of the lower platen assembly 38 and the upper platen assembly 40 nearest the transfer section to eject the bale 22 from the press section 24.

During this ejection the bale is maintained under compression by the compression and conveying surfaces of the press section and by similar conveying surfaces disposed in the transfer section 28. These latter conveying surfaces are presented by upper and lower conveyor assemblies 58 and 60 mounted in the transfer section 28 and disposed in longitudinal alignment with the press section 24.

Inasmuch as these conveyor assemblies 58 and 60 are, apart from length and differences attributable to the driving arrangement, substantially structurally identical to the platen assemblies of the press section 24, they will not be described in detail. It will, however, be appreciated that the transfer section conveyor assemblies 58 and 60 are mounted in vertically stationary positions.

As the bale 22 is incrementally advanced through the transfer section 28, it passes through the strapping section 30 where an automatic strapping unit schematically depicted at 62 is mounted. It is important to note that the portions of the bale 22 on opposite sides of the strapping zone are maintained in compressed state during strapping. On the one hand, the conveyor assemblies 58 and 60 of the transfer section 28 maintain compression in the bale portions that have not been incrementally advanced into the strapping section 80. Compression rolls 65 immediately beyond the strapping zone maintain compression on the bale on the other side of that strapping zone.

Although some relaxation of necessity will occur by reason of time lag before the initial incremental advance of portions of the bale to these compression rolls 65, very little will occur at the initial strapping zone on the bale because of the bulk of the bale, which is made up of layers, is still under compression at the transfer section 28. This compression will resist expansion at the free end of the bale in the short time before it passes to the compression rolls 65. As sequential straps are applied, it will be appreciated that bale portions on opposite sides of the strapping zone are maintained under compression by the transfer section on the one hand, and by the previously applied straps and the compression rolls 65 on the other hand. Thus, significant relaxation at the strapping zone is militated against.

The strapping unit 62 itself may be of generally a conventional type that includes a track schematically at 64 extending circumferentially about the strapping zone. The track 64 generally defines a loop longitudinally aligned with the press and transfer sections 24 and 28, which loop guides a metal band or strap that is propelled by the strapping unit about the bale back to a position where its free end is manipulated so that the bale is tightly strapped and tied. For this purpose a strapping head of the Model G-29 type available from Interlake, Inc., Chicago, Illinois, and described in an instruction manual Form 1209 R 11-72, may be employed, and modified to permit the track 64 to be positioned immediately adjacent the transfer section so as to further militate against bale expansion. In this connection, it should be noted that the strapping unit includes a sealing feeder plunger, at the zone indicated at 67, for sealing the band in its taut position around the bale. In the above-mentioned strapping head before modification, ways for guiding vertical movement of the sealing feeder plunger were disposed on the face of the unit which would be disposed adjacent the side of the bale thereby presenting interference problems with the transfer conveyor assembly. When modified so that the ways are disposed on surfaces orthogonal to the bale side, the interference problems are essentially eliminated.

After strapping the bale 22 is transported by the transfer section 32 to the bagging section 34, and from there to the shrink section 36. Suitable conveyors schematically shown at 66, 68 and 70 may be appropriately located to so transport the bale for exiting from the end 72 of the shrink section as a completely packaged unit. One such conveyor 66 includes the previously identified compression rolls 65.

In the bagging section 34 a heat shrinkable packaging material is enveloped about the bale as the bale is transported therethrough. At the heat shrinking station 36, heat is supplied to shrink the packaging material about the bale as it is transported through the exit end 71.

DETAILED STRUCTURE AND OPERATION:

The Platen Assemblies

In FIGS. 2–9 further details of the previously identified upper and lower platen assemblies 38, 40 and 42 of the press section 24 may be seen.

The lower platen assembly 38 is comprised of a generally rectangular framework with interconnected end plates 72 and side members 74, the side members being formed from I-beams as best shown in FIGS. 4 and 5. Extending generally parallel to and intermediate the side members 74 is a central I-beam 76 connected at its ends to the end members 72. Transverse box beams 78 project through this central I-beam at locations spaced from the end members 72. These box beams are connected to the side members 74. The various elements of the platen assembly framework may be comprised of steel and may be suitably interconnected as by welding.

The upper ends of the side members 74 and central member 76 are each provided with rails 80 to define generally T-shaped tracks on which elongate, movable compression and conveyor elements 82 of the platen are supported. These compression and conveyor elements 84 together define the earlier mentioned transient compression and conveying surface of the lower platen assembly 38. That surface is indicated generally at 84 in FIG. 2.

Figure 10:
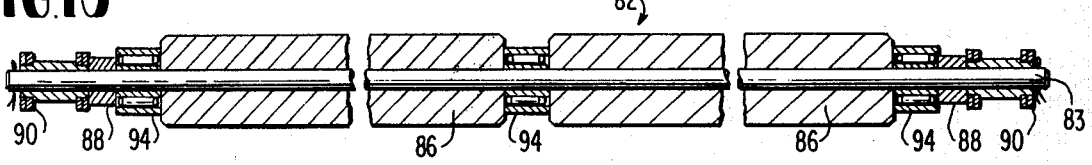
FIG. 10 is a cross-sectional view of a typical one of the compression and conveyor elements of the lower platen assembly.

As shown in FIG. 10, each of the conveyor and compression elements 82 includes an elongate shaft member 83 and terminates at its ends in bars 88. These bars 88 are secured to adjacent interconnected links 90 of chains 92 (see FIG. 3) disposed on each side of the lower platen assembly 38. Thus, the compression and conveyor elements 82 are carried by the chains 92 with the end bars 88 of those elements 82 constituting some of the chain link pins.

Adjacent each of these bars 88, the shafts 83 are provided with needle bearings 94 which ride on the rails or tracks 80. An additional needle bearing 94 is provided centrally of each shaft 83, and this central bearing rides on the central track 80.

Between the needle bearings 80, the shaft 83 is surrounded by enlarged cylindrical sleeves 86 fixed thereto. It is these sleeves 86 that actually establish compressive contact with and transport the bale, i.e. the sleeves 86 facing the cotton bale together define the transient compression and conveyor surface 84. Similar compression and conveyor surfaces 85 and 87 are provided in connection with the upper platen assemblies 40 and 42 (see FIG. 2). It will be appreciated that the dimensions and spacings of the sleeves 86 are such that the gaps between the sleeves are minimal.

The sprocket chains 92 cooperate with sprocket wheels 94. These sprocket wheels 94 are disposed on the ends of sprocket support shafts 96 extending transversely of the platen framework adjacent the end frame members 72. (See FIGS. 7 and 9).

To minimize the diameter of the sprocket wheels 94, and thus to minimize the gap between the compression and conveyor surfaces in the press section 24 and the conveyor surfaces in the transfer section 28, two such sprocket wheels 94 and support shafts 96 are provided at each end of the platen framework. The shafts and sprockets that are disposed nearest the bale forming and transport locations (i.e. the upper ends of the lower platen assembly 38 and the lower ends of the upper platen assemblies 40 and 42) are positioned laterally outward of the other shafts and sprockets.

In the illustrated embodiment of the present invention, provision is made for maintaining the chains 92 in taut condition. For that purpose, mounting of the sprocket shafts 96 is accomplished by aligned sleeve bearings 98 attached to upright, spaced plates 100. (See FIGS. 7–9). These plates 100 are in turn suitably fixed to back plates 102 extending transversely of the sleeve bearing support plates 100 and disposed adjacent the platen framework end members 72.

Projecting from the back plates 102 to a location between the bearing support plates 100 are vertically spaced flanges 104. These flanges are provided with aligned apertures, one of which may be threaded, for receiving a pivot bolt 106.

Together, each set of the support plates 100, the backing plates 102 and the flanges 104 provide a sleeve bearing mounting assembly 105 that is pivotable about its associated pivot bolt 106.

The pivot bolts 106 each extend through a block 108 disposed between the flanges 104. Each such block 108 projects through an aperture in the associated plate 102 and is suitably secured to a translatable chain slack take-up shaft 110.

These take up shafts 110 project through holes in the platen framework end members 72 and are slidably supported in bearing housings 112. Each bearing housing may be welded in position between the framework end member and the nearest one of the earlier noted box beams 78.

Aligned with and suitably connected to each take-up shaft 110 is a piston 114 whose displacement is controlled by an air operated diaphragm assembly 116. These diaphragm assemblies may be of a conventional type and may be suitably mounted within the framework of the platen assembly 38 such as by the bracket 117 shown. Two such diaphragm assemblies 116 are provided in connection with one end of the lower platen assembly 38, one being associated with each of the sleeve bearing mounting assemblies 105 at that end. The diaphragm assemblies may be of the type available from Wagner Electric Sales Corporation, St. Louis, Missouri as brake chambers with replacement diaphragms of the type depicted in Catalog KU 350, in April 1971.

When the diaphragm assemblies are pressurized (as through a common supply hose means 119*a* from any suitable pressurized air source, not shown), any slack in the chain 92 will permit extension of one or both of the pistons 114. In turn, the associated take-up shaft 110 is extended as is the block 108 connected thereto. During such extension, the associated sleeve bearing mounting assembly 105 is also extended through force applied from the block 108 through the pin 106 to the flanges 104.

This latter extension is accommodated by reason of the sleeve bearing mounting assembly being permitted to pivot about the axis of the pivot bolt 106. As will be appreciated, the sprocket shaft 96 carried thereby also will pivot, an this pivoting is accomodated by pivoting of the sleeve bearing mounting assembly 105 at the other end of that shaft 96 about its associated pivot bolt 106.

Provision is made for establishing alignment of the two sleeve bearing mounting assemblies 105 at each end of the platen assembly so as to facilitate assembly of the sprocket shafts 96. In this connection, each assembly is pivotable about the axis of the take up shaft by reason of mounting of that shaft 102 for rotation in its bearing 112 relative to the displacement piston rod 114.

As earlier noted a drive assembly (described more fully below) is provided to reciprocate the transient compression and conveying surfaces 84, 85 and 87 to cause cotton gripped therebetween to traverse the cotton feeding zone 46. As this occurs the batt 26 is caused to fold upon itself and the bale 22 is formed in stages through successive compression of overlapping cotton layers.

Inasmuch as the construction of the upper platen assemblies 40 and 42 is, apart from length similar to that of lower platen assembly 38, the former need not be described in detail. It will, however be appreciated that to minimize weight and cost factors, the number of compression and conveying elements 82 is maintained at approximately the minimum as governed by the oscillation stroke of the respective compression and conveying surfaces 84, 85 and 87. As will be apparent, during reciprocation, the compression and conveying elements 82 of the upper platen assemblies 40 and 42 travel a path that moves them at one point in the cycle around each end of the associated platen assembly.

In this regard, at each of both upper platen assemblies star wheels 118 are rotatably mounted on the sprocket shafts 96. These star wheels, several of which may be seen in FIG. 2, are arranged in alignment with each of the tracks 80 and provide support for the needle bearings 94 as the compression and conveyor elements 82 are driven around the platen ends.

Since, as will be pointed out below, the lower compression and conveying surface 82 is driven about the end of the lower platen assembly 38 during bale ejection, similar star wheels are provided at that end.

Figures 2, 6:
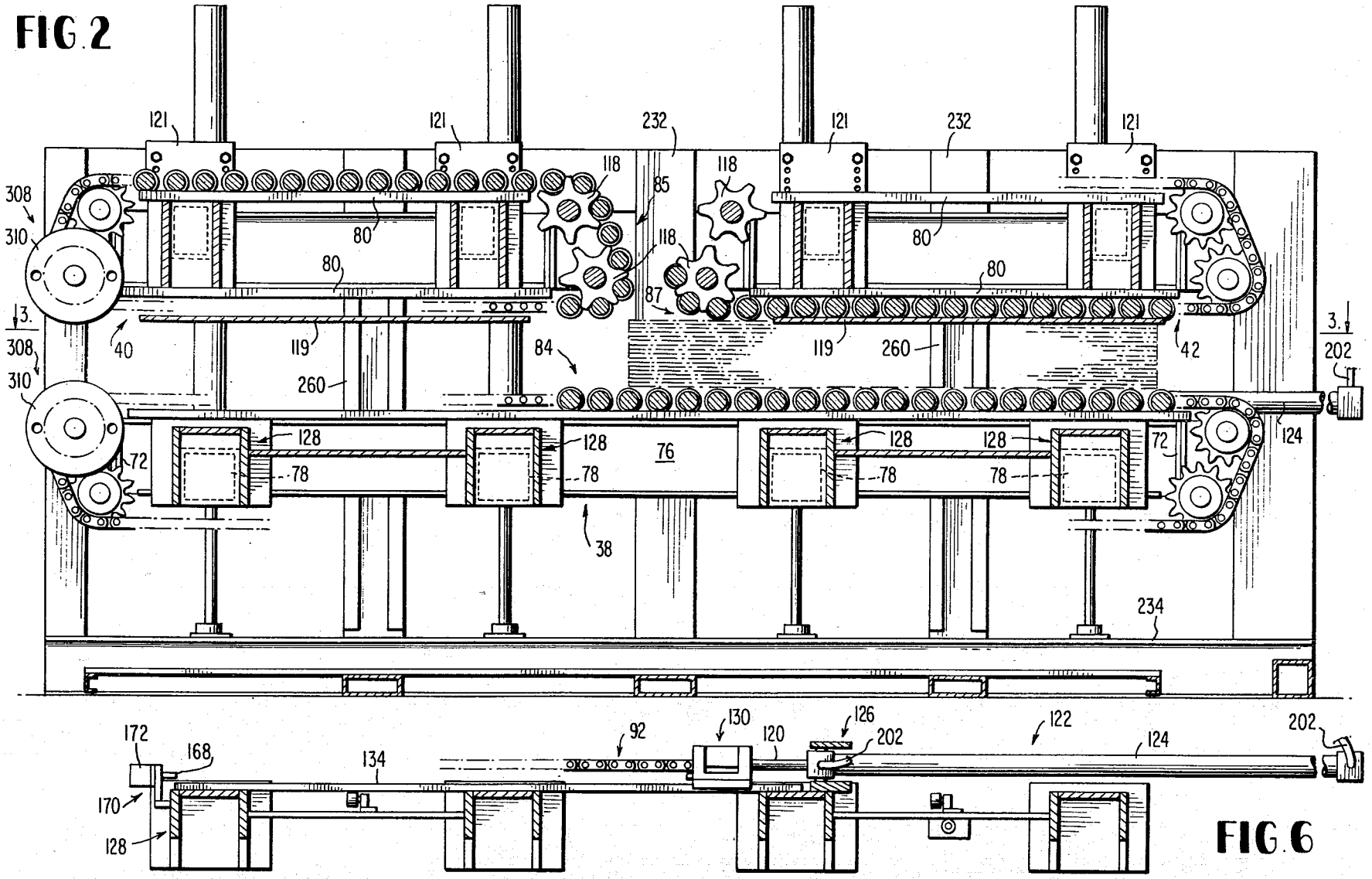
FIG. 6 is a cross-sectional view taken along line 6—6 of FIG. 3 and illustrating the drive for the compression and conveying elements of the lower platen assembly.

Two further differences between the upper platen assemblies 40 and 42 and the lower platen assembly 38 may be seen in FIGS. 2 and 4. As depicted therein, the upper platen assemblies include suitably attached ledges 119 positioned beneath the outer tracks 80. The end needle bearings 94 of the compression and conveying elements 82 are supported by engagement with those ledges 119 and the adjacent tracks 80 when those elements pass along the underside of the upper platen assemblies 40 and 42. In addition, the upper platen assemblies are fixedly positioned on the apparatus framework by bracket and bolt assemblies 121.

Platen Compression and Conveying Surface Drive

Driving of the transient compression and conveying surfaces 84, the lower platens 38 is accomplished through reciprocation of a piston rod members 120 of piston and cylinder assembly 124. (See FIGS. 2, 3 and 6).

Each piston and cylinder assembly 122 includes a cylinder 124 suitably supported by one or more brackets 126 fixed to outrigger projections 128 extending laterally outwardly from the sides 74 of the platen framework, and attached thereto adjacent the locations of the framework box beams 78 (see also FIG. 4). As such, the piston and cylinder assemblies 122 extend generally parallel to the plane of the chains 92 but are laterally offset therefrom.

Connected to the free end of each reciprocable piston rod 120 is a chain clutching assembly 130. The chain clutching assemblies 130 are operable to latch onto the chains 92 to enforce oscillation thereof in response to reciprocation of the piston rods 120. Inasmuch as the transient compression and conveying surface 84 is carried by the chain 92, this in turn causes longitudinally oscillatory movement of that surface 84.

Figure 12:
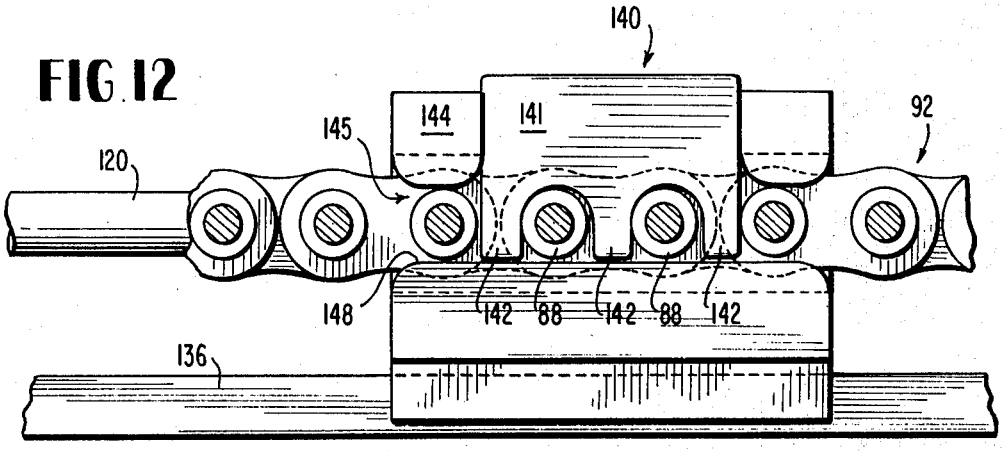
FIG. 12 is a side view of that latching mechanism taken along lines 12—12 of FIG. 11.

As best viewed in FIGS. 11 and 12, each chain clutching assembly 130 includes a latch housing 132, the bottom face of which is constructed with a projection 134 defining a channel. This channel rides on a longitudinally extending rail 136.

The rails 136 may be suitably attached to the upper portions of the outrigger projections 128 and project for a length sufficient to accomodate the stroke of the associated piston rods 120. During reciprocation of those rods the rails 136 guide the chain clutching assembly 130. If desired, the inner faces 138 of the channel may be constructed of a suitable material that minimizes friction as the clutching assembly 130 rides on the rail 136.

Pivotally mounted on the latch housing 132 is a dog or latch 140. As shown in FIG. 11, this latch 140 has a front face 141 with a generally fork-like appearance including three prongs 142 separated by generally U-shaped slots. The prongs 142 are thus adapted to fit between adjacent ones of the chain link pins defined by the end projections 88 of the compression and conveying elements 82. When the pistons 120 are reciprocated driving of the chains 92 is accomplished through force transmitted by the prongs 142 to these chain link pins 88.

From FIGS. 11 and 12 it may be seen that the chain link pins 88 project into a channel 145 defined in the front face 144 of the latch housing 132 generally centrally thereof, and the outermost portions of the chain links project into a recessed, larger channel 146 communicating with the front channel 145. At the same time, the latch 140 is recessed behind its front face 141, as indicated at 148, in conformity with the configuration of the recessed channel so as to accomodate the outermost chain link portions when the latch 140 is in its chain drive position.

Movement of the latch 140 between its downwardly pivoted chain drive position and its upwardly pivoted disengaged position (illustrated in phantom in FIG. 11) is accomplished by the alternate action of two pins 150 and 152 mounted internally of the latch housing 132. Each of these pins 150 and 152 constitutes a piston slidably received by a mounting block 154. The upper faces of the pistons are engageable with the latch 140 on opposite sides of a pivot pin 156 on which the latch is mounted. The lower piston faces communicate directly with fluid passages 158 and 159 in the latch housing.

In turn, each of these fluid passages 158 and 159 communicates through transfer passages 160 (see FIG. 12 and 13) with a further passage 162 and 163 that terminate at an outer face of the latch housing. Mounted within these latter passages 162 and 163 are alternately operable control pistons 164 and 165.

FIGS. 13 and 14 depict the relationship between the control pistons 164 and 165 and the pins 150 and 152 that are operable to pivot the latch 140. The control pistons 164 and 165 are movable in their receiving passages 162 and 163 between a position fully received within the latch housing 132 and positions wherein ends 167 and 169 thereof project beyond that housing 132. The amount of that projection is controllable by the amount of fluid in the passages 158, 159, 160, 162 and 163 between the inner ends of the control pistons 164 and 165 and the associated pins 150 and 152.

Any suitable fluid such as oil may be employed in an amount sufficient to insure that, on the one hand, when the one control piston 164 is moved by a given distance in a direction into the latch housing, the pin 150 with which it is in fluid communication is raised by an amount that will bring the latch 140 into its chain driving position, and, on the other hand, when the latch 140 is in its fully disengaged position, that control pin 164 projects by a predetermined amount from the housing.

If desired, a fluid filling passage (not shown) may be provided in the housing 132 to communicate with the fluid passages between the control piston 164 and the pin 150. The outer end of that filling passage may be capped by an allen screw or the like to permit adjustment of the predetermined outer position of the control piston 164.

In operation, to effect chain driving engagement of the latch 140, the control piston 164 may be selectively depressed within the latch housing through engagement with a suitable stop member 168 positioned adjacent the limit of the forward stroke of the latching assembly 130. As shown in FIG. 6, this stop member 168 may take the form of a finger mounted on a bracket 170 attached to one of the outrigger assemblies 128. That finger 168 may be selectively extended or retracted by providing a suitable signal to a solenoid device 172 or other suitable control mechanism of which the finger is a part.

As will be apparent when the finger 168 is signaled to extend, it will engage and depress the latching control piston 164 when the latch housing 128 reaches the end of its stroke. In turn the associated pin 150 is lifted to lift the tail of the latch 140 and cause chain engagement. Timing and stroke considerations will determine the amount the relative positions of the stop 168 and the control pin projection, etc. to insure proper entry of the latch prongs 142 between the chain link pins 88. In this connection, the solenoid actuated stop finger 168 may be extended through the agency of a pressurized source of air (not shown) so that when the control piston 164 initially engages the stop finger 168, that finger 168 will first be forced inward slightly against the air pressure before depression of the control piston 164 will occur.

When it becomes desirable to effect disengagement of the latch 140, as, for instance, in connection with bale ejection from the press section 24, the stop finer 168 is retracted and a similarly operated stop finger 169 (see FIG. 3) is signalled to extend. That finger is cooperable with the unlatching control piston 165 which is, in a manner similar to that described in connection with effecting chain drive, depressed so as to lift its associated pin 152. That lifting causes movement of the latch to its disengaged phantom position of FIG. 11.

It will be appreciated that at the same time, the other latch operating pin 150 is depressed from its FIG. 13 position so as to project its associated control piston 164 into readiness for another latching operation when such is desired.

As may be seen in FIGS. 22 and 23, the manner in which oscillation of the upper platen transient compression and conveying surfaces 85 and 87 is accomplished is substantially the same as that in which the lower compression conveying surface 84 is oscillated, and therefore it need not be described in detail. Certain structural modifications are, however, involved owing to the fact that two separate platen units are involved. In this connection, unlike the case with the lower platen assembly, the chains which carry the compression and conveying elements 82 are not directly driven. Rather, an auxiliary chain 174 is provided on one side of the upper platen assemblies. This chain 174 is entrained about and is operable to drive additional sprockets 176. Those sprockets are mounted upon extensions of the shafts 96 that support the sprockets 94 which cooperate with the chain 92 carrying the compression and conveying elements in a manner to effect driving of that chain 92 in response to driving of the auxiliary chain 174.

Two suitably mounted chain drive cylinder assemblies 122*a* and 122*b*, each with pistons 120 having about the same stroking limit of the lower chain drive pistons 120, are ganged together to provide the driving input. In this fashion the force input for driving the chain 174 is rendered approximately equal to that for the lower platen assembly where one chain drive assembly 122 is employed on each side.

A chain latching assembly 130 and cooperating stops (not shown) similar to the earlier described stops 168 and 169 operate in a manner similar to that described in connection with those that effect driving engagement and disengagement at the lower platen assembly.

It will also be appreciated that the stroke of the drive cylinder assemblies 122*a* and 122*b* is oppositely directed as compared with the drive cylinder assembly 122 of the lower platen assembly so that synchronous drive of the upper and lower transient compression and conveying surfaces adjacent the bale occurs in the same linear sense.

Control of the oscillation of the upper and lower compression and conveying surfaces 82, 85 and 87 is accomplished by the earlier mentioned drive synchronizing assembly 56. From FIGS. 15 and 16 it may be seen that this assembly is mounted on a suitable frame 180.

The frame 180 may be disposed adjacent the frame 31 for the press section 24 and the other sections 28, 30, 32, 34, and 36 through which the bale 32 is transported.

Included in the drive synchronizing assembly 56 are a pair of piston and cylinder assemblies 182 having cylinders 184 mounted on a support 186 that is pivotally attached to the lower end of the frame 180, at the location indicated at 188. Each piston and cylinder assembly has a piston rod 190, both of which are fixed to a support 192 pivotally attached to a pin 193 that is eccentrically fixed to a large gear 194 at a location indicated at 196.

As the gear 194 is rotated the piston rods 190 are cyclically reciprocated with harmonic motion. This motion is transmitted to pistons within the cylinders 184 to produce a fluid output through one or the other of fluid ports 198 and 200 at opposite cylinder ends. This output is through suitable hoses 202 (see FIG. 2), transmitted to fluid ports at one end of the cylinders 124 of the upper and lower chain drive piston and cylinder assemblies 122. As will be apparent, the chain drive piston and cylinder assemblies thus function as slave units and produce a fluid output that is returned to the other of the fluid ports 198 and 200 of the master units 182 at the synchronized drive assembly 56.

Since the two master units 182 function together, the slave drive chain units also function together so as to effect synchronized driving of both the lower compression and conveying surface 84 and the upper compression and conveying surfaces 85 and 87.

For convenience, the stroke of the master piston rods 190 is one half the stroke of the slave piston rods 120 in the upper and lower compression conveying surface drives, with the diameter of the cylinder 124 of the latter being halved.

The fluid controlled harmonic synchronized drive provided for the compression and conveying surfaces is particularly significant since the chains carrying the compression and conveying surfaces 82 with the bale 22 being formed therebetween constitute a considerably large mass to be moved. The fluid controlled harmonic motion automatically accounts for the inertial effects of that mass both at the beginning and ending portions of the oscillation cycle.

Driving of the gear 194 may be accomplished in any suitable matter. In the illustrated driving arrangement a 75 horsepower, variable speed driving system is provided. The system includes a 50 horsepower motor 204 with an output shaft 206 that drives a belt pulley assembly 208. An output shift 210 of this pulley assembly 208 is operable to drive a first chain and gear reduction unit 212 that is in turn coupled to a second chain and gear reduction unit 214, the output shaft 216 of carries a gear 218 that drives the large gear 194 through a chain 220.

A second, 25 horsepower motor 222 has an output shaft 224 that drives variable pitch pulley 226. Through belts, that pulley 226 drives a planetary gear transmission 228 mounted on the output shaft 210 of first pulley assembly 208.

Through the foregoing arrangement a 25 percent speed variation in the driving of the large gear 194, and thus in the oscillation of of the transient compression and conveying surfaces 84, 85 and 87. may be accomplished depending upon whether the planetary gear transmission 228 is operated by its associated motor 222 to provide maximum or mimimum speed of rotation of the output shaft 210.

The Cotton Compression System

Referring now to FIGS. 2–4 and 17, further details of the preferred system for compressing the cotton during oscillation of the transient compression and conveying surfaces may be understood. As earlier noted, this compression is accomplished through the action of the compression control piston and cylinder assemblies 48–55 which are operable to lift the lower platen assembly 38 and to yieldably resist its lowering during bale formation.

FIG. 4 best illustrates how force is transmitted between the lower platen assembly and the compression control piston and cylinder assemblies. In this connection, each of the outrigger assemblies 128 of the lower platen assembly 38 includes a lifting and lowering bracket 230 extending into the zone between adjacent upright beams 232 of the apparatus support frame 31 and above the lower, side beams 234 of that frame. Each bracket 230 includes a cylinder mounting plate 236 provided with a frustoconical opening 240 through which the cylinder 238 of the associated compression control piston and cylinder assembly is inserted. The lower end of the cylinder 238 is capped by an enlarged collar member 242 that bears against the lower surface of the plate 236 to provide for force transmission between the cylinder 238 and the lower platen assembly 38 as the cylinder 238 is raised and lowered.

Raising of the cylinders 238 is accomodated by openings 244 in the upper side beams 246 of the apparatus support frame 31.

Projecting from the lower end of each cylinder 238 is a piston rod 248 provided with an enlarged head 250 seated in a frustoconical opening 252 of a receiving socket 254 fixed to a lower, side beam 234 of the frame 31.

The piston rod head 250 is not fixed in the socket 254 and merely rests therein. As such, the frustoconical nature of the socket opening 252 and the cylinder receiving opening 240 permit a limited amount of departure of the generally upright piston and cylinder assemblies 48–55 from the vertical. This feature aids in the prevention of binding as the massive lower platen assembly 38 is raised and lowered.

Particularly during lowering, which occurs during oscillation of the transient compression and conveying surfaces 84, 85 and 87 as the bale size increases, binding prevention becomes significant. Additional structural accomodation in this regard is provided by the platen guiding system associated with the raising and lowering of the lower platen assembly.

Included in that guiding system are tracking roller units 256 mounted on generally L-shaped support members 258 that extend between and are connected to adjacent outrigger assembies 128. As may be seen in FIG. 3, two such tracking roller units 256 are included on each side of the lower platen assembly 38.

Each of those units 256 includes rollers 262 that ride on upright rails 260 mounted on the upright beams 232 of the apparatus support frame 31. On one laterally aligned pair of those units 256, additional rollers 264 ride between the associate upright rails 260 and may contact one or the other of them. However, the other laterally aligned pair of tracking roller units does not include the additional rollers in order to avoid binding during the slight longitudinal tilting of the lower platen assembly 38 which may occur during vertical platen movement. The rollers 264 mounted for riding between the rails 260 are mounted on the vertical faces of the support members 258, and do not take up the entire space between the rails, thereby allowing tilting to take place.

FIG. 17 schematically depicts the arrangement of the hydraulic and pneumatic fluid circuitry relating to the operation of the compression control piston and cylinder assemblies 48–55 that control such platen movement.

To raise the lower platen assembly 38, fluid is supplied through a port 268 in the cylinders 238 above the pistons 270 located therein. This fluid comes from oil reservoirs 272 through low pressure line hoses indicated by the light double lines 274 in FIG. 17. Check valves 27 in the lower pressure line hoses prevent return flow of fluid through those hoses to the reservoirs 272.

The low pressure line fluid is supplied at about 150 p.s.i. by introducing compressed air, indicated at 278, into the reservoirs through a solenoid air valves 280. The compressed air is provided by a suitable supply 282 connected through a check valve 284 in an air supply line 286 (the single line in FIG. 17). That air supply line 286 is connected to a plurality of compressed air reservoirs 288. Two parallel sets of such reservoirs are shown in FIG. 17 as being connected in series to one another and, through one of the solenoid air valves 280, in series respectively to one of the oil reservoirs 272.

Figure 3:
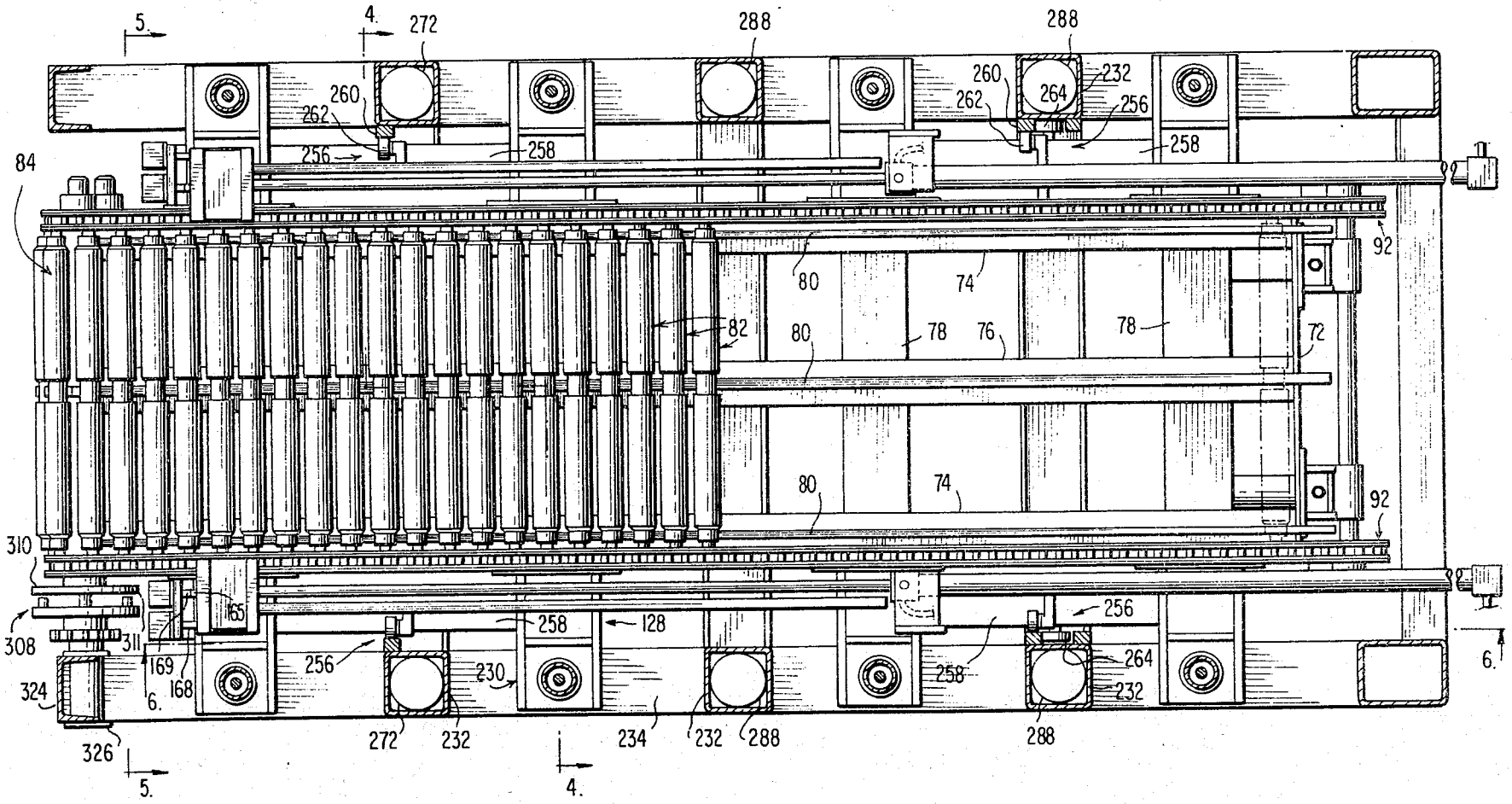
FIG. 3 is a cross-sectional view of the press section taken along line 3—3 of FIG. 2.

In FIG. 3 it may be seen that the oil reservoirs 272 and the compressed air reservoirs 288 may be physically located within the hollow upright beams 232 of the apparatus support frame 31.

It will be appreciated that in response to an appropriate control signal being applied to the solenoid air valves 280, compressed air enters the oil reservoirs 272 and displaces fluid at the desired low pressure therefrom into the cylinders 238. In connection with those cylinders 238 located at the ends of the lower platen assembly 38 (i.e., the cylinders of the end piston and cylinder assemblies 48, 49, 54, and 55) the low pressure fluid is supplied by one oil reservoir 272 through a flow control valve 290. This insures a relatively even flow to the end cylinders so as to provide minimized possiblility of tilting of the lower platen assembly 38 during lifting.

Fluid supplied to the cylinders 238 located intermediate the platen assembly ends (i.e., the cylinders of the interior piston and cylinder assemblies 50, 51, 52 and 53) may be supplied from the other oil reservoir 272 through a manifold 292. The oil reservoirs may themselves be interconnected to equalize pressurized fluid flow.

After the lower platen assembly 38 is lifted to its start position with the lower transient compression and conveying surface 84 adjacent the upper transient compression and conveying surfaces 85 and 87, the solenoid air valves 280 may be signalled to close and oscillation of the compression and conveying surfaces commenced. As build up of the bale 22 occurs the weight supported by the cylinders 238 increases thereby increasing the pressure within. An adjustable pop-off valve 294 controls the amount of permitted pressure increase. That valve 294 communicates one of the oil reservoirs 272 with the cylinders 238 through high pressure hoses, indicated by the solid double line 296 in FIG. 17. In practice a setting for the pop-off valve 294 that permits cylinder pressure increase to about 3,000 p.s.i. has been employed. However, the setting will vary depending upon the dimensions of the bale being formed and its desired density.

A suitable air pressure release valve (not shown) may be employed to reduce the pressure in the oil reservoirs 272.

It may be seen from FIG. 17 that the high pressure flow out of each of the cylinders 238 is isolated from that of the others by check valves 298. Such isolation is preferred in order to allow for smooth, gradual platen lowering, rather than an abrupt jerking type lowering action, and to enhance uniform compression along the bale length while the bale is being translated.

It will be appreciated that such isolation may cause slight longitudinal tilting of the platen assembly 38, and that such tilting is permitted by the roller guiding system earlier described.

When the lower platen assembly reaches its lowest position any compression and conveying elements 82 on the underside thereof ride on tracks 299 as shown in phantom in FIG. 5.

Bale Ejection

After the bale 22 is formed to the desired dimensions and density, the previously described chain latching assembly 130 of the press section 24 is disengaged, and the bale 22 is ejected into the transfer section 28. This is accomplished by driving of the transfer conveyors 58 and 60 in conjunction with the adjacent upper platen assembly 40 and the lower platen assembly 38.

As earlier noted the transfer conveyors 58 and 60 are substantially identical in construction to the platen assemblies and are fixedly mounted in longitudinal alignment therewith. Each transfer conveyor includes conveying elements 82 carried by a chain 92 entrained about sprockets 94 mounted to sprocket shafts 96 (See FIG. 18). The conveying elements 82 present transient conveying surfaces 81 that are operable to maintain compression on the bale 22 ejected into the transfer section 28 and to advance the bale therethrough.

In this regard it may be seen in FIG. 18 that a drive chain 300 is entrained around a driving sprocket 301 and driven sprockets 302 respectively associated with each of the transfer conveyors. As described more fully below the driven sprockets 302 may be clutchingly engaged in driving relationship with the sprocket shafts 96 that support the conveying element carrying chains 92 of the transfer conveyors.

The driving sprocket 301 is rotatable by a motor 304 suitably mounted on the upper portion of the apparatus support frame 31.

The path of travel of the drive chain 300 includes passage about further driven sprockets 305 associated with the lower platen assembly 38 and the upper platen assembly 40 adjacent the transfer section 28, and also about an idler sprocket 306 suitably mounted on the apparatus support frame 31. Through the operation of clutch mechanisms 308 (see FIGS. 2 and 3) these driven sprockets 305 are operable to drive the compression and conveying surfaces 84 and 85 of the associated platen assemblies 38 and 40.

Similar clutch mechanisms 308 are associated with the driven sprockets 302 that operate the transfer conveyors 58 and 60. The structure and operation of the clutch mechanisms 308 may be more fully understood with reference to FIGS. 2, 3, and 18–20.

Each clutch mechanism 308 includes a longitudinally fixed, rotatable clutch plate 310 suitalbly keyed to an extension 311 of the sprocket shaft 96. Two diametrically opposite pin receiving holes 312 are provided in the clutch plate 310.

These pin receiving holes 312 are cooperable with pins 314 project from an axially movable, rotatable clutch plate 316 fixedly attached to the driver sprocket 305 by spacer 318. Thus, when the movable clutch plate 316 is projected toward the fixed clutch plate 310 to cause engagement of the pins 314 in the receiving holes 312, rotation of the driven sprocket 305 will cause the chains 92 of the associated platen assemblies to be driven.

Engagement and disengagement of the clutch plates 310 and 316 may be fluid controlled. For this purpose, a shifting shaft 320 is provided. The shaft 320 is coaxially fixed at one end to the assembly comprised of the driven sprocket 305, the spacer 318 and the movable clutch plate 316. At its other end, the shaft 320 is slidably and rotatably received in a double walled cylinder 322 mounted in an upright beam 324 of the apparatus support frame 31. The outer end of the cylinder 322 is closed by a backing plate 326. It should be noted that in the case of the clutch mechanisms 308 associated with the driven sprockets 302 that operate the transfer conveyors 58 and 60, extension brackets (not shown) from the nearest upright beams 324 mount the cylinders 322.

Coaxially mounted within bores in the ends of the shaft 320 are two pistons 328. Each piston receiving bore communicates with a fluid passage 330 disposed in the shaft. These passages 330 communicate with chambers 332 defined by grooves in the shaft and the internal wall of the cylinder 322. The chambers have a longitudinal extent sufficient to insure communication between the fluid passages 330 and ports 334 and 335 in the cylinder wall in both limit positions of the shifting shaft 320.

As will be apparent, clutching engagement of the pins 314 is accomplished by pressurizing one cylinder port 334 to cause the shifting shaft 320 to extend as shown in FIG. 19. Disengagement is accomplished by pressurizing the other cylinder port 335. The sprocket shaft extension 312 and the backing plate 328 act as stops for the pistons 328 to effect displacement of the shifting shaft 320.

In operation when bale ejection is desired, all four clutch mechanisms 308 are engaged, and the motor 304 is operated to drive the chain 300 in a direction to cause delivery of the bale into the transfer section 28. When that occurs, an appropriate signal causes disengagement of the clutch mechanisms 308 associated with the transfer conveyors, and the motor 304 is reversed.

The chain 300 is thus driven in a reverse direction to effect relocation of the compression and conveying surfaces 84 and 85 of the platen assemblies to the location at which they were when the ejection operation was commenced. Of course, during this repositioning, the bale 22 remains stationary in the transfer section 28.

When repositioning is completed, an appropriate signal causes driving of the chain 300 to cease, disengagement of the clutch mechanisms 308 associated with the platen assemblies, and engagement of the clutch mechanisms 308 associated with the transfer conveyors.

Thereafter, the latching assemblies 130 may be engaged to effect a further bale making operation, and the motor 304 may be simultaneously operated to incrementally advance the bale within the transfer section into the strapping section 30.

As will be apparent, when there is alternate engagement and disengagement of the clutch mechanisms 308 associated respectively with the transfer section and the press section, some lateral displacement of part of the chain 300 will occur. The length of the chain 300 is sufficient to accommodate that displacement while the chain remains in driving engagement with the sprockets 302 and 305.

Operational Sequence

With reference now to the schematic diagram of FIG. 21, the overall sequence of operation of the apparatus 20 may be more fully appreciated.

In this regard, it may be noted that an operator station, schematically shown at 350, may be located at a convenient position adjacent the portion of the apparatus depicted in FIG. 1. At the operator's station a suitable mode selector switch 352 may be conditioned by the operator for manual or automatic operational modes. The manual mode will be initially described.

With the mode selector switch 352 placed in the manual mode condition, the operator will first depress a control switch 354 at the operator station 350. Through appropriate circuitry in a master controller circuit 356, a signal is provided to a lower platen assembly elevator controller circuit 358. This controller in turn activates the solenoid air control valve 280 (see also FIG. 17) to effect lifting of the lower platen assembly 38 in the manner earlier described. The signal path 353, 355 and 357 indicated in FIG. 21 schematically depicts that operation.

When the lower platen assembly reaches its desired upper position adjacent the upper platen assemblies 40 and 42, the elevator control circuit 358 effects a closing of the solenoid air control valve 280. This may be accomplished utilizing a suitable platen upper position transducer 360. That transducer may be appropriately mounted on the apparatus framework 31 to be engageable with the lower platen assembly in its upper stroke limit position and may be operatively connected to the elevator control circuit as indicated at 362. The signal path 362, 363 depicts closing of the air valve 280.

At the same time that the lower platen elevation is occurring, the drive synchronizing assembly 56 (see also FIGS. 15 and 16) may be actuated. This is accomplished by a signal provided from the master controller circuit 356 to an oscillation drive controller circuit 364. The signal path is indicated at 353, 366. In turn that oscillation drive controller circuit 364 provides a signal, indicated at 368, to the motors 224 and 22 of the drive synchronizing assembly 56. In the manner earlier described, the slave piston and cylinders 122 (see FIG. 6) effect reciprocation of the chain latching assemblies 130.

When the operator sees that the upper platen assembly 38 is in its raised position and desires to commence bale formation, a second control switch 370 may be depressed at the operator station. A signal indicated at 372 to the master controller circuit 356 is thus provided, and the master controller circuit in turn sends a signal 374 to the drive controller circuit 364. In response thereto, a signal 376 is sent to the solenoid operated stop fingers 168, 169 associated with the control of the latching assemblies 130. In the manner earlier described, latching of the chains and oscillation of the transient compression conveying surfaces 84, 85, and 87 commences.

The batt 26 of cotton (FIG. 1) enters the press section 24 at the feeding zone 46 and full stroke oscillation is operative to build up a bale in the forming zone 44 through successive compression of overlapping layers of cotton. Each time the cotton gripped between the transient compression and conveying surfaces 84, 85 and 87 traverses the feeding zone 46 another layer is folded onto the bale. After the first layer is applied, the lower compression and conveying surface 84 remains in continuous engagement with the lower surface of the bale being formed.

As that surface moves from a position fully below one of the upper platen assemblies 40, 42 to a position fully below the other, the transient compression and conveyor elements of that one platen assembly are, as they pass around the platen assembly end, sequentially removed from engagement with the upper cotton layer, and the corresponding elements of the other platen assembly are sequentially engaged with the next layer. In other words, the upper compression and conveying elements "walk" onto and off the bale, and there is no relative translation between the bale and those elements engaged therewith.

While the bale 22 is being built up under compression, the lower platen assembly 38 is gradually lowered as previously described. When it reaches its full down position, a suitably mounted position transducer 378 sends a signal 380 to the elevator control circuit 358 which in turn sends a signal 382 to the master controller 356 that the bale has reached full size. The master controller circuit 356 then sends a signal 384 to the oscillation drive controller circuit 364 that in turn provides a signal 386 to the solenoid operated stop fingers 168, 169. In this manner, the latching assemblies 130 are disengaged and the bale 22 is stopped in the press section 24 adjacent the transfer section 28.

It will be appreciated that the longitudinal dimensions of the completed bale to be formed can be adjusted by altering the stroke of the oscillating transient compression and conveyor surfaces, and the height of the bale can be adjusted by altering the maximum spacing between the upper and lower platen assemblies. Moreover, the density of the bale of chosen size can be adjusted and/or monitored to accommodate cotton feed of different moisture content by adjusting the pop-off valve that controls platen lowering.

The operator can now eject the bale from the press section by depressing another control switch 386 at the operator station 35. This signals the master controller 356, through a signal 388, to signal a transfer controller 390 through a signal 392. The transfer controller 390 then provides a signal 394 to the transfer clutch assemblies 308 (FIGS. 19 and 20) and a signal 395 to the motor 304 associated therewith. Both the clutch assemblies 308 associated with the transfer conveyors 58 and 60 and those associated with the near upper platen assembly 40 and the lower platen assembly 38 ae engaged. As such the associated conveyor surfaces and transient compression and conveyor surfaces are driven together to eject the bale.

A suitable position transducer 396 may be employed in conjunction with the lower transient compression and conveyor surface to sense when the bale is ejected and to signal, through the transfer controller 390, the transfer clutch assemblies 308 of the transfer section to disengage. See signals 398 and 399 indicated in FIG. 21. At the same time, that position transducer 396 may signal the transfer motor 304 to stop, as indicated at 401.

The operator may now depress another control switch 402 at the operator's station. Through a signal 406 to the master controller 356 and from there to the transfer controller (see signal 408) and thence to the transfer motor 304 (see signal 410) the transfer motor is reversed to reset the lower transient compression and conveyor surface to the (FIG. 3) position it occupied prior to a transfer operation. Another position transducer 412 senses this repositioning and through signals 414, 416, and 420 causes the transfer clutches 308 of the press section to disengage and the transfer clutches 308 of the transfer section to engage. The operator may now repeat the earlier described operations associated with bale formation.

During formation of the next bale, the operator may sequentially depress control switch 422 and 424 which respectively operate the strapping head 62 and the transfer motor 304 to index the bale progressively into the strapping section 30 and apply the desired number of straps. Signals 426, 428, 430 for strapping are transmitted to the master controller 356 and to a strapping controller 432, and from there to the strapping head. Signals 433, 434, 436 for indexing the bale are transmitted to the master controller 356, to the transfer controller 390, and to the transfer motor 304.

When the bale is completely removed from the transfer section 30, a further control switch 438 is depressed to cause repositioning of the transfer conveyors through signals 440, 442 and 444. The next bale may then be transferred and strapped, and suitable control switches 446 and 448 may be depressed to effect bagging and heat shrinking operations through signals 450, 452 to and from the master controller.

The mode selector 352 and appropriate circuitry may be employed to effect automatic sequencing similar to that described above.

Although the present invention has been described with reference to preferred forms thereof, it will be appreciated by those skilled in the art that additions, modifications, substitutions, and deletions may be made without departing from the spirit and scope of the invention as defined in the appended claims.

What is claimed is:

1. A cotton baling press comprising:

first and second superposed platen means including cotton compression surfaces, at least one of said platen means being movable toward and away from the other of said platen means;

compression control means operable to place said platen means in a position of adjacency and to compressively resist separation thereof, said compression control means comprising:

a plurality of piston and cylinders assemblies disposed in longitudinally spaced positions along each side of said one platen means in force transmitting relationship therewith;

fluid supply means, conduit means for admitting fluid from said fluid supply means to the cylinders of said piston and cylinder assemblies and for transmitting fluid from said cylinders in response to separation of said platen means; and pressure control valve means for limiting flow of fluid from said cylinders to flow at a predetermined pressure, the outlet flow from at least some of said cylinders being isolated from one another by exit check valve means.

2. A cotton baling press according to claim 1 wherein:

said superposed platen means are disposed in a generally horizontal attitude with the lower one of said platen means being generally vertically movable toward and away from the upper one of said platen means under control of said piston and cylinder assemblies disposed in a generally upright position.

3. A cotton baling press according to claim 2 wherein:

said lower platen means includes outrigger assemblies in force transmitting relationship with said cylinders, said outrigger assemblies including generally frustoconical cylinder receiving apertures, and piston rods of said piston and cylinder assemblies being seated in a generally frustoconical socket, thereby to permit a limited amount of departure of said piston and cylinder assemblies from a generally upright position.

4. A cotton baling press according to claim 2 including:

mounting means for said piston and cylinder assemblies permitting a limited amount of departure thereof from an upright position.

5. A cotton baling press according to claim 4 including:

guiding means for guiding movement of said lower platen means, said guiding means being operable to accommodate tilting of said lower platen means.

6. A cotton baling press according to claim 5 wherein:

said compression surfaces comprise transient compression surfaces and said platen means are mounted in longitudinally stationary positions.

7. A cotton baling press according to claim 1 including:

flow divider means for generally equalizing flow from said fluid supply means to longitudinally outermost ones of said cylinders.

8. A cotton baling press according to claim 1 wherein:

said pressure control valve means is selectively adjustable to alter said predetermined pressure.

9. A cotton baling press according to claim 1 including:

pressurized air supply means for pressurizing said fluid supply means, and selectively operable valve means communicating said air supply means with said fluid supply means.

10. A cotton baling press comprising:

first and second upper platen means spaced from one another to define a cotton supply zone;

lower platen means disposed below said upper platen means to establish a bale forming zone therebetween, and generally vertically movable between a position of adjacency to said upper platen means and spaced positions;

said upper and lower platen means being operable to form a compressed cotton bale by successive compression of overlapping layers of supplied cotton; and a plurality of compression control piston and cylinder means, disposed in longitudinally spaced positions along each side of said lower platen assembly with movable portions in force transmitting relationship therewith, for raising said lower platen toward said upper platen means and compressively resisting lowering thereof during bale formation;

said piston and cylinder means being operable to permit tilting of said lower platen means during lowering thereto.

11. A cotton baling press according to claim 10 wherein:

said upper and lower platen means are mounted in longitudinally stationary positions and each includes transient compression and conveying surfaces operable to compressively grip cotton in said bale forming zone and to oscillate said gripped cotton beneath said cotton supply zone.

12. A cotton baling press according to claim 11 including:

mounting means for said piston and cylinder means permitting a limited amount of departure thereof from generally upright positions.

13. A cotton baling press according to claim 11 including:

fluid supply means;

first conduit means communicating said fluid supply means to cylinders of said piston and cylinder means;

inlet check valve means in said first conduit means for admitting low pressure fluid to said cylinders, second conduit means for transmitting high pressure fluid from said cylinders to said fluid supply means in response to lowering of said lower platen means;

pressure control pop-off valve means in said second conduit means for controlling flow of high pressure fluid from said cylinders; and exit check valve means for isolating from one another the flow of high pressure fluid from said cylinders.

14. A cotton baling press according to claim 13 including:

flow divider means for generally equalizing flow from said fluid supply means to longitudinally outermost ones of said cylinders.

15. A cotton baling press according to claim 13 including:

pressurizing air supply means for pressurizing said fluid supply means, and selectively operable valve means communicating said air supply means.

16. A cotton baling press according to claim 15 wherein:

said pressure control valve means is selectively adjustable to alter said predetermined pressure.

* * * * *